US005260742A

United States Patent [19]

Kikkawa

[11] Patent Number: 5,260,742

[45] Date of Patent: Nov. 9, 1993

[54] ELECTROPHOTOGRAPHIC COPYING MACHINE USING MEMORY CARD

[75] Inventor: Shinichi Kikkawa, Ogaki, Japan

[73] Assignee: Sanyo Electric Co., Ltd., Osaka, Japan

[21] Appl. No.: 785,206

[22] Filed: Oct. 24, 1991

Related U.S. Application Data

[63] Continuation of Ser. No. 271,027, Nov. 14, 1988, abandoned.

[30] Foreign Application Priority Data

Nov. 16, 1987 [JP] Japan ..... 62-288826

[51] Int. Cl.[5] ..... G03G 15/00; G03G 21/00

[52] U.S. Cl. ..... 355/202; 355/204; 355/209

[58] Field of Search ..... 355/202, 204, 209, 313, 355/133

[56] References Cited

U.S. PATENT DOCUMENTS 3,974,363 8/1976 Malinich ..... 355/313 X
4,764,789 8/1988 Iwaki et al. ..... 355/209
4,780,806 10/1988 Wada et al. ..... 355/200 X
4,799,081 1/1989 Kikuno et al. ..... 355/209
4,806,978 2/1989 Nakatani et al. ..... 355/202
4,821,107 4/1989 Naito et al. ..... 355/202 X
4,990,954 2/1991 Higashio et al. ..... 355/313 X

*Primary Examiner*—Fred L. Braun
*Attorney, Agent, or Firm*—Darby & Darby

[57] ABSTRACT

An electrophotographic copying machine includes a card loading portion for loading a memory card, and the memory card having a memory in which copy data such as copied quantity can be stored is loaded into the card loading portion. Copying condition such as copying quantity and copying magnification being set by an operator in a first mode is displayed on a quantity display and magnification display. When a reset key and an insertion key are simultaneously operated, the electrophotographic copying machine is changed to a second mode. In the second mode, the copy data being stored in the memory of the memory card is displayed on the quantity display and magnification display.

17 Claims, 16 Drawing Sheets

FIG. 7A

| | |
|---|---|
| 9A00 | IDENTIFICATION NUMBER |
| 9A03 | TOTAL COPIED QUANTITY |
| | COPIED QUANTITY OF A3 |
| | COPIED QUANTITY OF B4 |
| | COPIED QUANTITY OF A4 |
| | COPIED QUANTITY OF B5 |
| | COPIED QUANTITY OF A5 |
| 9A15 | UNIT PRICE OF A3 |
| | UNIT PRICE OF B4 |
| | UNIT PRICE OF A4 |
| | UNIT PRICE OF B5 |
| | UNIT PRICE OF A5 |
| 9A29 | TOTAL COPIED QUANTITY TOTALIZED WITH RESPECT TO ALL CARDS |
| | COPIED QUANTITY OF A3 AS TOTALIZED |
| | COPIED QUANTITY OF B4 AS TOTALIZED |
| | COPIED QUANTITY OF A4 AS TOTALIZED |
| | COPIED QUANTITY OF B5 AS TOTALIZED |
| | COPIED QUANTITY OF A5 AS TOTALIZED |
| 9A3B | NUMBER OF TOTALIZED CARDS |
| 9A3D | |

FIG. 7B

| | | |
|---|---|---|
| 8A00 | FOR 1ST PPC | IDENTIFICATION NUMBER |
| | " | TOTAL COPIED QUANTITY |
| | | COPIED QUANTITY OF A3 |
| | | COPIED QUANTITY OF A5 |
| 8A15 | FOR 2ND PPC | IDENTIFICATION NUMBER |
| | " | TOTAL COPIED QUANTITY |
| | | COPIED QUANTITY OF A3 |
| | | COPIED QUANTITY OF A5 |
| 8A2A | FOR 3RD PPC | IDENTIFICATION NUMBER |
| | ≈ | ≈ |
| 8B7A | FOR 19TH PPC | IDENTIFICATION NUMBER |
| | " | TOTAL COPIED QUANTITY |
| | | COPIED QUANTITY OF A3 |
| | | COPIED QUANTITY OF A5 |
| 8B8F | FOR 20TH PPC | IDENTIFICATION NUMBER |
| | " | TOTAL COPIED QUANTITY |
| | | COPIED QUANTITY OF A3 |
| | | COPIED QUANTITY OF A5 |
| 8BA4 | FOR CARD | TOTAL COPIED QUANTITY |
| | | COPIED QUANTITY OF A3 |
| | | COPIED QUANTITY OF A5 |
| 8BB6 | | |

ELECTROPHOTOGRAPHIC COPYING MACHINE USING MEMORY CARD

This is a continuation of application Ser. No. 271,027, filed Nov. 14, 1988, now abandoned.

BACKGROUND OF THE INVENTION

1. Field of the invention

The present invention relates to an electrophotographic copying machine. More specifically, the present invention relates to an electrophotographic copying machine which can not be used without loading an IC card having a peculiar identification number being registered in advance, whereby a department capable of using the electrophotographic copying machine, copied quantity, and etc. can be controlled by using the IC card.

2. Description of the prior art

One example of such an electrophotographic copying machine is disclosed in, for example, Japanese Patent Laid-open No. 165664/1985. The electrophotographic copying machine comprises a display for displaying possible copied quantity which is set in advance for each department to which a card is assigned and a display for displaying copied quantity executed by loading the card other than displays inherent in the copying machine, for example, a quantity display and a magnification display.

Such a conventional copying machine, it is necessary to provide with particular displaying device having a display for displaying possible quantity for each department and a display for displaying actual copied quantity, and therefore, if such display devices are provided on an operation panel of the copying machine, the operation panel becomes large and complex.

In addition, only by two displays having no functions capable of being changed, copy data capable of being displayed on the displays becomes only the possible copying quantity and the actual copied quantity totalized irrespective of paper sizes, and therefore, it is impossible to perform more detail control function.

SUMMARY OF THE INVENTION

Therefore, a principal object of the present invention is to provide an electrophotographic copying machine capable of displaying necessary copy data without increasing the number of displays on an operation panel.

In brief, an electrophotographic copying machine in accordance with the present invention comprises a memory card having a memory capable of storing copy data; a card loading portion for loading the memory card thereinto; a display for displaying a copying condition being set by an operator in a first mode; mode changing means for changing the electrophotographic copying machine to a second mode; and displaying data applying means for applying the copy data being stored in the memory of the memory card to the display when the second mode is set by the mode changing means.

When the electrophotographic copying machine is in the first mode, such as copying quantity or copying magnification set by the operator is displayed on the display.

In order to confirm the copy data being stored in the memory card, the electrophotographic copying machine is first changed to the second mode by the mode changing means. When the second mode is set, the copy data such as possible copying quantity for each department or actual copied quantity being stored in the memory card is applied to the above described display by the displaying data applying means and such copy data is displayed on the display.

In accordance with the present invention, it is possible to display the copy data being stored in the memory card on the display which is inherently provided for displaying the copying condition set by the operator. Therefore, it is not necessary to provide with an exclusive display for displaying the copy data for each card as done in the conventional copying machine. In addition, if arbitrary one of various kinds of copy data can be selectively displayed on the display as items to be displayed on the display are changed by utilizing operation keys for inherently setting the copying condition, it is possible to easily control for larger number of the items, for example, not only the copied quantity for each department but also copied quantity for each paper size and costs of copy.

The objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIG. 7A is an illustrative view showing a memory map of a RAM of an electrophotographic copying machine.

FIG. 7B is an illustrative view showing a memory map of a RAM of an IC card.

DETAIL DESCRIPTION OF THE PREFERRED EMBODIMENTS

Figure 1:
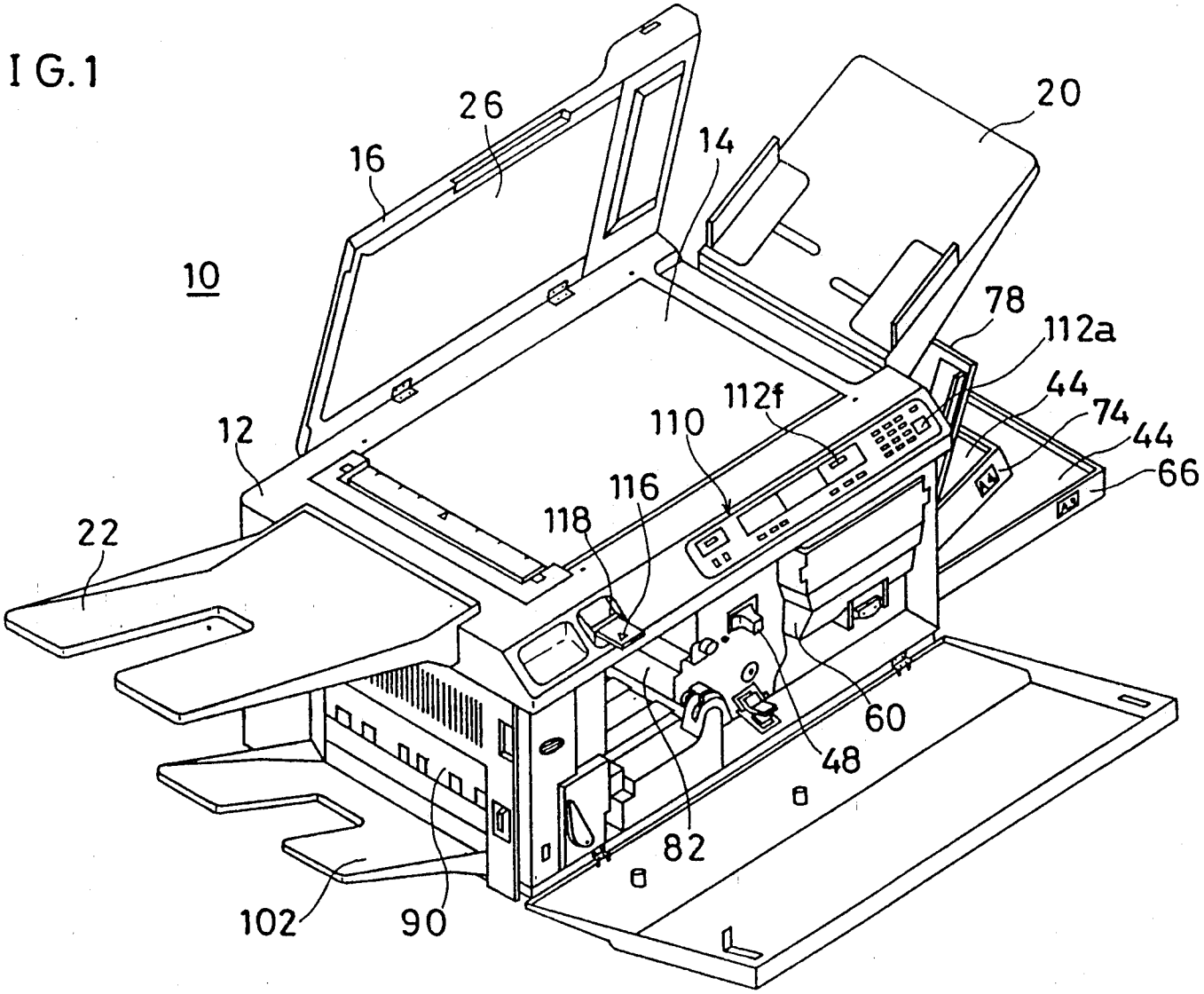
FIG. 1 is a whole appearance view showing one embodiment in accordance with the present invention.
Figure 2:
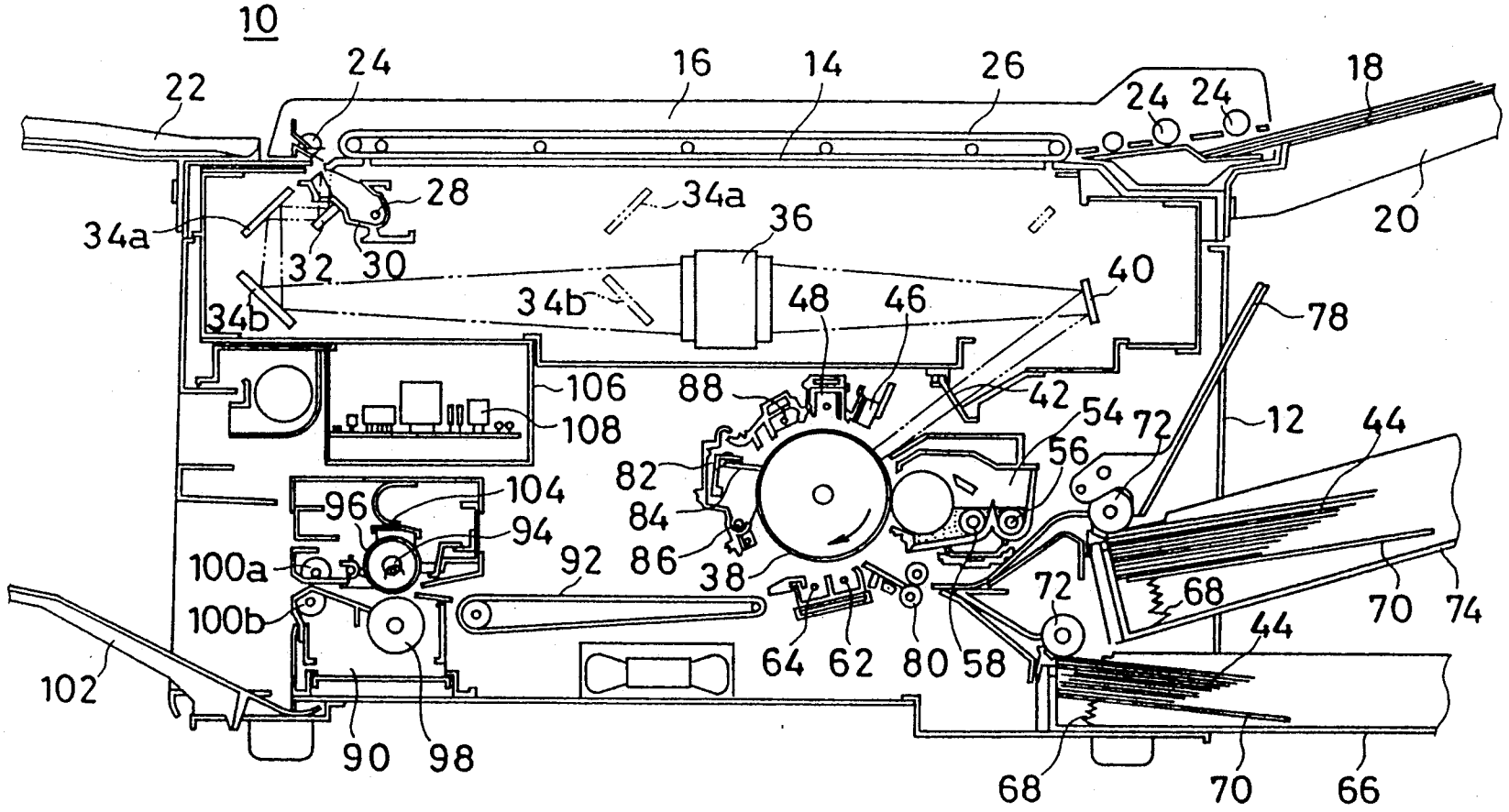
FIG. 2 is an illustrative cross-sectional view showing an inner structure of FIG. 1 embodiment.

FIG. 1 and FIG. 2 are structural views showing a copying machine included in one embodiment in accordance with the present invention, especially, FIG. 1 is a perspective view thereof and FIG. 2 is an inner structural view thereof. An electrophotographic copying machine 10 includes a main unit 12. An original table 14 composed of a transparent glass plate is fixedly provided on the top of the main unit 12. Above the original table 14, an automatic document feeder 16 is mounted by a hinge at the side end thereof. The automatic document feeder 16 includes a plurality of rollers 24 and an endless belt 26 such that an original 18 put on an original feeding table 20 can be fetched and transferred onto the original table 14. The original which has been copied through the automatic document feeder 16 is transferred to an original receiving table 22.

Below the original table 14, a light source 28 as an optically scanning means for exposing and scanning the original 18 is installed in the main unit 12. The light source 28 is made movable from one end of the original table 14 to the other end thereof and vice versa. A movement of the light source 28 toward left and right is performed by a driving force of a servo motor (not shown). Associated with the light source 28, a reflecting mirror 30 having an elliptic cross-section is installed. A first movable mirror 32 is fixed to the reflecting mirror 30. When the light source 28 is moved toward right in FIG. 2 by the servo motor, the original 18 put on the original table 14 is subjected to a slit-exposure. However, when the light source 28 is moved toward left in FIG. 2 no exposure is made.

In association with the first movable mirror 32, a pair of second movable mirrors 34*a* and 34*b* are provided. The pair of second movable mirrors 34*a* and 34*b* are for reflecting again an original image reflected by the first movable mirror 32 toward a focusing lens 36. The second movable mirrors 34*a* and 34*b* are moved in the same direction as the light source 28 at a half speed thereof. In addition, the focusing lens 36 is, in the embodiment shown, constructed by a zoom lens, and therefore, a copying magnification can be changed.

In front of the zoom lens 36, a fixed reflecting mirror 40 is installed so as to reflect the original image through the lens 36 toward a photosensitive drum 38. An infrared light absorbing filter 42 is interposed between the fixed reflecting mirror 40 and the photosensitive drum 38.

At the downstream side from an exposed position of the photosensitive drum 38, that is, the position where the original image is focused by the fixed reflecting mirror 40, a partial erasure lamp 46 composed of, for example, an LED array is installed which partly erases a useless electrostatic latent image. At the upstream side from the partial erasure lamp 46, a charging corotron 48 for uniformly charging the photosensitive drum 38 in a predetermined polarity is installed.

At the downstream side from the exposed position of the photosensitive drum 38, a developing device 54 is installed. The developing device 54 develops the electrostatic latent image which is formed on the photosensitive drum 38 by the charging corotron 46, the light source 28 and the zoom lens 36 by using a toner. Associated with the developing device 54, there are provided an agitator roller 56 for agitating a toner and a supplying roller 58 for supplying the charged toner to the photosensitive drum 38.

At one side of the main unit 12, a paper supplying part is formed. In the paper supplying part as shown, two paper feed cassettes 66 and 74 are attachably/detachably attached. Copy papers 44 having a different size are respectively accommodated in a stack fashion in the paper feed cassettes 66 and 74. At the bottom part of the paper feed cassettes 66 and 74, coil springs 68 for pushing up the stacked paper 44 and supporting plates 70, respectively. The copy papers 44 accommodated in the paper feed cassettes 66 and 74 are pushed up by the coil springs 68 and the supporting plates 70, the upper most copy paper 44 is brought in contact with paper feed rollers 72 to be picked up. One of the paper feed rollers 72 sends the copy paper 44 being pressure-contacted from the paper feed cassette 66 or 74 to a register roller 80 one by one in rotation thereof. In addition, a manually feeding plate 78 is provided in association with the upper one of the paper feed rollers.

At the downstream side from the developing device 54, a transferring corotron 62 and a separating corotron 64 are installed in a one-piece fashion.

When a copy paper 44 is fed from the paper feed cassette 66 or 74, a toner image formed on the photosensitive drum 38 is transferred onto the copy paper 44 by the transferring corotron 62. In transferring by the transferring corotron 62, the paper 44 is absorbed by the photosensitive drum 38 and intends to move together with the same, but the copy paper 44 is separated by the separating corotron 64, being fed toward a vacuum conveyer 92.

A cleaning device 82 is installed at the downstream side from the separating corotron 66 and in the vicinity of the peripheral side surface of the photosensitive drum 38. The cleaning device 82 removes a toner left on the photosensitive drum 38 after transferring onto the copy paper 44. The cleaning device 82 includes a rubber blade 84 for scraping off the remaining toner from the photosensitive drum 38. The toner scraped off by the blade 84 is conveyed to a waste toner container by a screw conveyer 86.

At the further downstream side from the cleaning device 82, an erasure lamp 88 for removing a charge remaining on the photosensitive drum 38 is installed. At the downstream side from the erasure lamp 88, there is arranged the above-described charging corotron 46.

The copy paper 44 separated by the separating corotron 64 is sent to a fixing device 90 by the vacuum conveyer 92. The fixing device 90 is constituted with a heating roller 96 incorporating a heater 94 and a pressing roller 98 in pressure contact with the heating roller 96. The copy paper 44 on which the toner image is transferred is inserted between the heating roller 96 and the pressing roller 98, and thereby the same is heated and pressed to fix the toner image. The copy paper 44 after fixing is discharged onto a copy receiving tray 102 by discharging rollers 100*a* and 100*b*.

Furthermore, a control box 106 is formed above the fixing device 90 in the main unit 12. In the control box 106, there are accommodated circuit parts 108.

An operation panel 110 is provided on an upper surface of this side of the main unit 12 of the electrophotographic copying machine 10. In addition, the most of keys provided on the operation panel 110 have a multi-utility such that the keys can perform functions as another operation keys in a service mode other than functions inherent in a normal copying mode.

Figure 3:
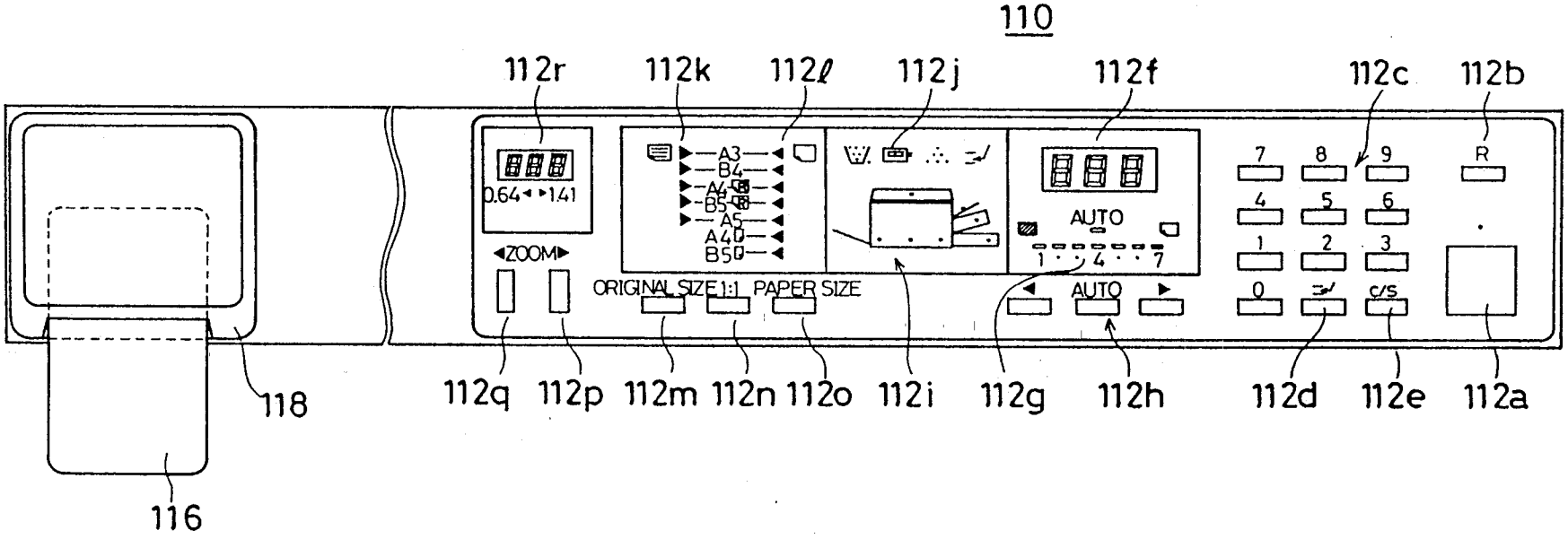
FIG. 3 is an illustrative view showing an operation panel of the embodiment.

First, functions of the keys in the copying mode will be described. In reference to FIG. 1 and FIG. 3, a start key 112*a* for commanding to start of a copying process is provided at the right end of the operation panel 110. Above the start key 112*a*, a reset key 112*b* for releasing a mode set by an operation of the keys in the operation panel 110 is provided. At the left side of the start key 112*a*, a ten-key 112*c* for setting copying quantity. The ten-key 112*c* includes an insertion key 112*d* for processing an insertion copy and a clear,/stop key 112*e* for releasing the copying quantity set in setting copying condition and for stopping succeeding copying process in a continuous copying mode.

The copy quantity set by the ten-key 112*c* is displayed on a quantity display 112 provided at the left side thereof. The quantity display 112*f* is a display of 3 digits each of which is composed of 7 segments.

A density setting key 112h for setting density of a copy image is provided below the quantity display 112f. A density indicator 112g for indicating density of the copy image being set by the density setting key 112h is provided between the quantity display 112f and the density setting key 112h. The density setting key 112h includes an up key, a down key and an auto key. When the density is to be automatically set, the auto key is operated and when the density is to be manually set, the up key or down key operated. When the density has been automatically set, "AUTO" of the density indicator 112g is lightened and, when the density has been manually set, the set density is indicated on the density indicator 12g in seven notches.

At the left side of the quantity display 112f and the density indicator 112g, a status indicator 112i is provided, which is for indicating occurrences of a jam, a lack of toner, a lack of copy paper or the like. Then, a card loading indicator 112j is formed in the status indicator 112i, which indicates whether or not an IC card described later has been loaded into a card receiving portion described later. The card loading indicator 112j is lightened when the IC card has not been loaded to the card receiving portion.

At the left side of the status indicator 112i, an original size indicator 112j and a paper size indicator 112l for respectively indicating the size of the original and the size of the copy paper are provided. Keys 112m–112o for setting the sizes of the original and the copy paper are provided blow the original size indicator 112k and the paper size indicator 112l. More specifically, decision which of two paper feed cassettes 66 and 74 attached as shown in FIG. 1 should be used is made by operating a paper size selecting key 112o. When a paper size is set by the paper size selecting key 112o, only one of seven LEDs of the paper size indicator 112l is lightened so as to correspond to the set paper size. When the original size is set by the original size setting key 112m, responsibly, only one of five LEDs of the original size indicator 112k is lightened so as to correspond to the set original size. When the original size and the paper size are thus set by the original size setting key 112m and the paper size selecting key 112o, magnification for enlargement or reduction of copy can be automatically decided. The decided magnification is displayed on a display described later.

An equal magnification key 112n is operated when an equal magnification copy should be made irrespective of the original size and the paper size.

At the left side of the original size setting key 112m, a zoom-up key 112p and a zoom-down key 112q for respectively setting magnification for enlargement or reduction are provided. The magnification set by keys 112p or 112q is displayed on a magnification display 112r being provided thereabove. In addition, only when the above described the original size setting key 112m and the equal magnification key 112n have not been operated, the zoom-up key 112p and the zoom-down key 112q can be effectively operated. More specifically, when the copying magnification is automatically set by operating the original size setting key 112m and the paper size selecting key 112o, the copying magnification thus automatically set is displayed on the magnification display 112r.

A card receiving portion 118 having a slit-like card insertion opening is formed at the left side end of the operation panel 110, to which an IC card 116 can be attachably/detachably loaded. As described above, if the IC card 116 is loaded into the card receiving portion 118, the card loading indicator 112j of the status indicator 112i is put out.

Next, other functions of respective keys in the above described operation panel 110 will be described. When a power switch (not shown) of the electrophotographic copying machine 10 is turned on, if the reset key 112b and insertion key 112d are simultaneously depressed, the mode of the electrophotographic copying machine 10 is changed from the first mode, that is, the copying mode to the second mode, that is, the service mode, and respective operation keys and respective displays or indicators in the operation panel 110 function as operation keys and displays or indicators for reading or writing data from or to the electrophotographic copying machine 10 (hereinafter, often called as "PPC") and/or the IC card 116. Command numbers and functions corresponding thereto in the service mode are described in a next table.

TABLE

| command numbers | functions |
|---|---|
| C1 | reading data of copied quantity from IC card |
| C2 | calculating copy cost in IC card |
| C3 | totalizing data of a plurality of IC cards |
| C4 | totalizing and reading copied quantity of IC cards |
| C5 | totalizing and calculating copy cost of IC cards |
| C11 | reading data of copied quantity in PPC |
| C12 | calculating copy cost in PPC |
| C51 | clearing all data of IC card |
| C52 | registering identification number in IC card |
| C53 | clearing all data of PPC |
| C54 | registering identification number in PPC |
| C55 | storing unit price of copy in PPC |
| C91 | reading copied quantity for each of IC card and PPC |
| C92 | data transfer (from PPC to IC card) |
| C93 | data transfer (from IC card to PPC) |

As indicated in the above table, the command numbers used in the service mode of this embodiment shown is 15 kinds from "C1" to "C93" including missing numbers and these command numbers can be displayed on the magnification display 112r as described later.

The electrophotographic copying machine 10 is changed from the copying mode to the service mode by turning on the power source thereof in the state where the reset key 112b and the insertion key 112d are simultaneously operated. At this initial state, the command number "C1" is displayed on the magnification display 112r. Thereafter, if the zoom-up key 112p is operated, at each operation thereof, the command number is succeedingly changed from "C1" to "C93". On the other hand, if the zoom-down key 112q operated, the command number is succeedingly changed from "C93" to "C1". In addition, if the zoom-down key 112q is operated when the command number has been set as "C1", no change occurs in the command number being displayed on the magnification display 112r, and the zoom-up key 112p is operated when the command number has been set as "C93", no change occurs in the command number being displayed on the magnification display 112r. Therefore, in order to change or renew the command number, for example, from "C1" to "C51" by operating the zoom-up key 112p, the zoom-up key 112p may be operated seven times.

By operating the start key 112a after displaying the command numbers "C1–C12" on the magnification display 112r, processing respective one of the command functions corresponding to respective one of the command numbers as set is performed in the electrophotographic copying machine 10, and respective numeral values are displayed on the quantity display 112*f* and the magnification display 112*r* as necessary.

A mode set by the command numbers "C51 to C55" is a mode for performing initial setting of the IC card 116 and the electrophotographic copying machine 10. More specifically, when the command number "C51" is set, a mode for clearing all of the copy data being stored in the IC card 116 is set. Therefore, when the reset key 112*b* and the clear/stop key 112*e* are simultaneously operated after displaying the command number "C51" on the magnification display 112*r*, the whole data being stored in the IC card 116 is cleared. Then, "000" is displayed on the quantity display 112*f* and, "000" is displayed by 2 seconds on the magnification display 112*f* which displays the command number "C51".

If the command number "C52" is set, a mode for registering the identification number of the IC card 116 is set. Therefore, the start key 112*a* is operated after the command number "C52" is displayed on the magnification display 112*r*, in response to the number of times of operations of the start key 112*a*, 20 kinds of identification numbers being registered in the IC card 116 sequentially displayed on the quantity display 112*f*. Then, if the identification number should be changed, the identification number which has been registered is cleared by operating the clear/stop key 112*e*, and thereafter, new identification number is registered by operating the ten-key 112*c*. In addition, one of the identification numbers which intend to be registered should be the same as the identification number of the electrophotographic copying machine 10 which is registered in the mode set by the command number "C54" described later.

It is possible to register the identification numbers different from each other for respective one of 20 sets of the electrophotographic copying machines in the IC card 116. Therefore, when the start key 112*a* is operated, numeral value indicating that the identification number is of what number of the electrophotographic copying machine is displayed on the magnification display 112*r*. For example, if the identification number is of the first electrophotographic copying machine, "01-" is displayed on the magnification display 112*r*.

A mode set by the command number "C53" is an all clear mode for clearing all of the data being stored in the electrophotographic copying machine 10, for example, the identification number thereof and the data of the copied quantity performed by that electrophotographic copying machine. As similar to the clear mode of the command number "C51", in this clear mode, by simultaneously operating the reset key 112*b* and the clear/stop key 112*e* after displaying the command number "C53" on the magnification display 112*r*, all of the data can be cleared. When all of the data has been cleared, "000" is displayed on the quantity display 112*f* and "000"is displayed on the magnification display 112*r* by 2 seconds.

By setting the command number "C54", the electrophotographic copying machine 10 is set as a mode for registering the identification number thereof. When the identification number of the electrophotographic copying machine 10 is to be registered, if the command number "C54" is set after the all clear mode of the command number "C53", "000" is displayed on the quantity display 112*f* even if the start key 112*a* is operated; however, if the "C54" is set without performing the all clear mode of the command number "C53", when the start key 112*a* is operated, the identification number of 3 digits which has been registered is displayed on the quantity display 112*f*. Then, if the clear/stop key 112*e* is operated, the identification number being displayed is cleared. Then, after displaying the new identification number on the quantity display 112*f* by operating the ten-key 12*c*, if the start key 112*a* is operated, the new identification number is registered in the electrophotographic copying machine 10.

When the command number "C55" is set, a mode for registering unit price of copy for each paper size is set. After all of the data of the electrophotographic copying machine 10 have been cleared in the mode of command number "C53", by displaying the command number "C55" on magnification display 112*r* and operating the start key 112*a*, "000" are displayed on the both of the magnification display 112*r* and the quantity display 112*f*. However, by setting the command number "C55" without passing the all clear mode of the command number "C53" and operating the start key 112*a* thereafter, the unit price corresponding to the paper size indicated by the paper size indicator 112*l* can be displayed on the magnification display 112*r* and the quantity display 112*f*. At this time, for example, the value of "yen" is displayed on the magnification display 112*r* and the value of "sen" (=1/100 yen) is displayed on the quantity display 112*f*. If the unit price of the paper size "A3" is "12 yen 34 sen", "12" is displayed on the magnification display 112*r* and "−34" is displayed on the quantity display 112*f*. Designation of the paper size is performed by operating the paper size selecting key 112*o*, and if the unit price for that paper size should be newly set, after the numeral value of the unit price to be registered is displayed on the magnification display 112*r* and the quantity display 112*f* by operating the ten-key 112*c* and the clear/stop key 112*e*, when the start key 112*a* is operated, the unit price for the designated paper size being indicated by the paper size indicator 112*l* is registered.

Modes set by the command numbers "C91–C93" are modes for backing-up the data of the RAM of the main unit 12. In the case where necessity for exchanging a control circuit board mounted within the control box 106 takes place due to any breakdown, before exchanging the control circuit board, the data of the RAM is transferred to the IC card 116 and the data is re-transferred from the IC card to the RAM after exchanging the board so as to preventing from the data being burnished.

More specifically, a mode set by the command number "C91" is a mode for confirming the last data of the electrophotographic copying machine is stored in what number of the IC cards in the case where one electrophotographic copying machine is commonly used to a plurality of IC cards 116. When the data has been burnished due to breakdown of the RAM within the control box 106 of the main unit 12, if the plurality of the IC cards 116 are used to the electrophotographic copying machine, the last data of the electrophotographic copying machine must be stored in any one of the IC card 116. Therefore, by seeking the IC card 16 in which the last data is stored, and the last data being stored in the IC card 116 thus sought may be transferred to a new RAM after exchanging the control circuit board. In this case, the command number "C91" is, first, displayed on the magnification display 112*r* and, the identification number of the electrophotographic copying machine is inputted by using the ten key 112c. Thereafter, the data of the copied quantity being stored is read from the IC card 116 by depressing the start key 112a. By searching the data of the copied quantity thus read to seek one in which the largest value of the copied quantity is stored such that the IC card in which the last copy data of the electrophotographic copying machine is stored can be found out.

A mode set by the command number "C92" is a mode for temporarily transferring the data of the RAM to the IC card 116 when the other ICs are broken down even though a MPU, ROM and RAM within the control box 106 are maintained in a normal state. At this time, after displaying the command number "C92" is displayed on the magnification display 112r, the reset key 112b and a "1"key of the ten-key 112c are simultaneously operated such that the data of the RAM is transferred to the IC card 116 being loaded to the electrophotographic copying machine 10.

A mode set by the command number "C93" is a mode for transferring the data from the IC card 116 to a RAM mounted on a control circuit board newly exchanged. At this time, after the service mode is set, the identification number is registered in the mode of the command number "C54". Thereafter, after displaying the command number "C93" on the magnification display 112r, when the reset key 112b and a "7"key within the ten-key 112c are simultaneously operated, the data temporarily stored in the IC card 116 is re-transferred to the RAM.

Figure 4:
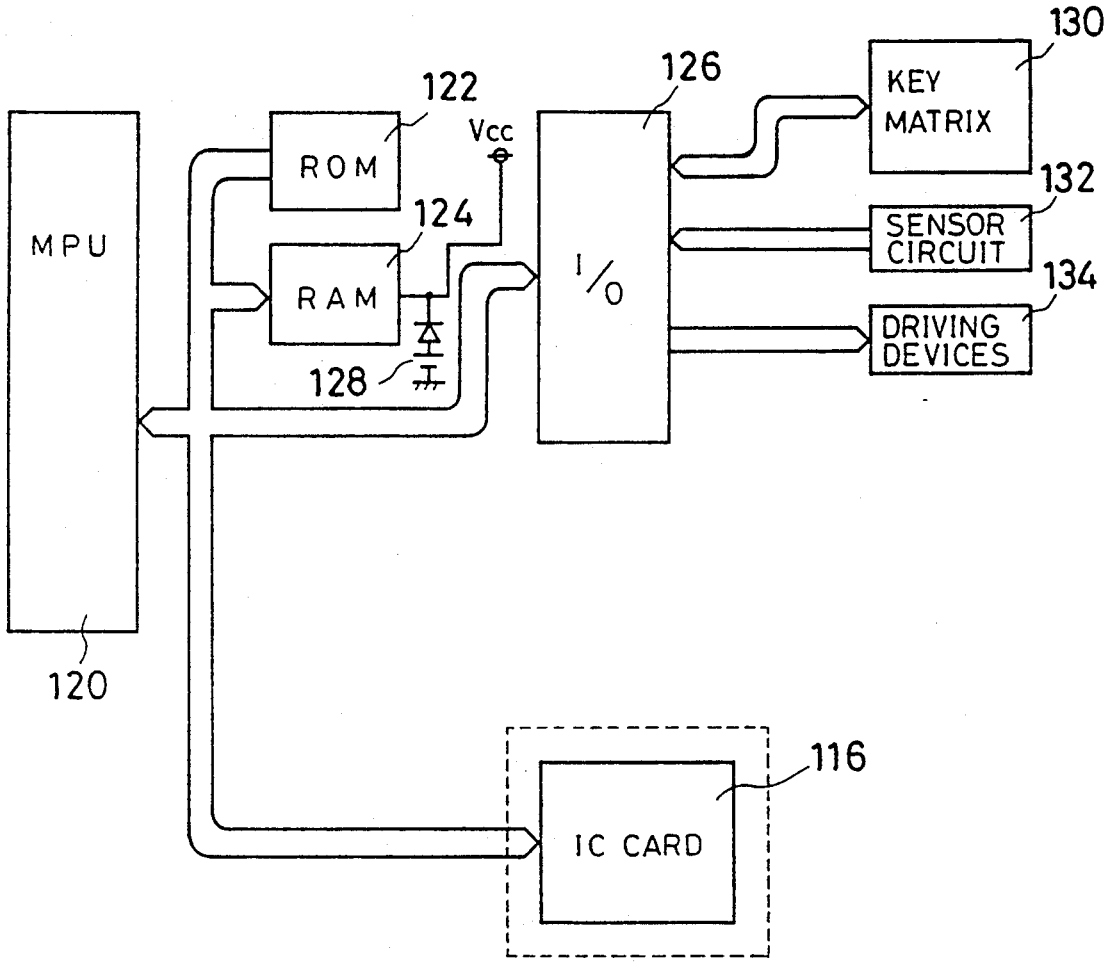
FIG. 4 is a block diagram showing a structure of the embodiment.

FIG. 4 is a block diagram of a control portion of the electrophotographic copying machine. The electrophotographic copying machine 10 is controlled by a microcomputer system including an MPU 120. The microcomputer system including a ROM 122 connected to the MPU 120 and for storing control programs, a RAM 124 for temporarily storing data in controlling by the MPU 120 and having various flag areas necessary for controlling, and an I/O interface 126 for making the MPU 120 to control input and output to and from internal equipments of the main unit.

In addition, RAM 124 is backed-up by a backup battery 128 such as a lithium battery being connected to a voltage Vcc. If the voltage Vcc is stopped to be supplied, the voltage of the backup battery 128 is applied to the RAM 124. Therefore, if a power source switch of the electrophotographic copying machine 10 is turned off, the data of the RAM 124 can be maintained.

To an input port of the I/O interface 126, data of a key matrix 130 of the operation panel 110 and output of a sensor circuit 132 including a paper size sensor are inputted.

To an output port of the I/O interface 126, a plurality of driving devices 134 such a motor, solenoid and so on are connected.

Figure 5:
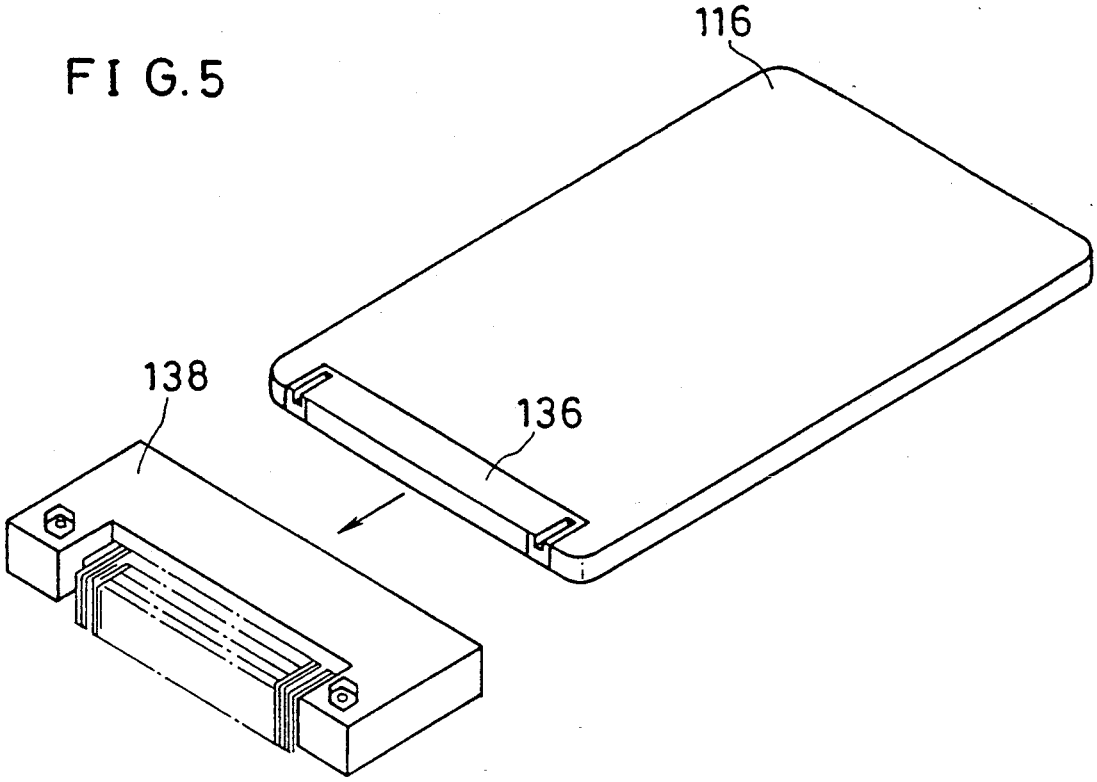
FIG. 5 is a perspective view showing one example of an IC card.
Figure 6:
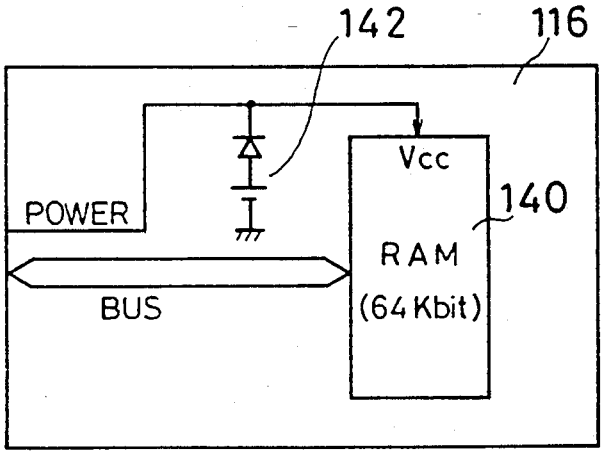
FIG. 6 is a block diagram showing a structure of the IC card shown in FIG. 5.

FIG. 5 is a perspective view showing an IC card as one example of a storage medium, and FIG. 6 is a block diagram thereof. A receptacle connector 136 is fixed at the front end of the IC card 116 so as to be able to insert or pull out to or from a header-type connector 138 which is provided in the card insertion portions 118 and of the main unit 12. The header-type connector 138 may be connected to control portions of the electrophotographic copying machine 10.

A RAM 140 of 64 Kbits is incorporated in the IC card 116, which transfers or receives data and a control signal to or from the control portion via the connectors 136 and 138. The RAM 140 is backed-up by backup battery 142 such as a lithium battery being connected to a power terminal Vcc and data written into the RAM 140 is held even if the IC card 116 is in the state where the IC card 116 is pulled out from the header type connector 138.

FIG. 7A shows a memory map of the RAM 124 of the electrophotographic copying machine 10 and FIG. 7B shows a memory map of the RAM 140 of the IC card 116.

In 3 bytes of the addresses "9A00–9A02" of the RAM 124 of the main unit, as shown in FIG. 7A, the identification number of 3 digits of the electrophotographic copying machine 10 is stored. Data of the copied quantity performed by the electrophotographic copying machine 10 is stored in the addresses "9A03–9A14". Data of a total copied quantity is stored in the addresses "9A03–9A05" and in the addresses "9A06–9A14", data of the copied quantity for each paper size are stored in each 3 bytes. In the addresses "9A15–9A28", data of the unit price for each paper size are stored in each 4 bytes. It is possible to set as the unit price for each paper size up to 4 digits of "99 yen 99 sen" in the largest, one digit is correspondingly stored in one byte. In the addresses "9A29–9A3C", data in association with the total copied quantity totalized with respect to a plurality of the IC cards 116, the copied quantity for each paper size and the number of the IC cards 116 which are totalized in the mode of the command number "C3" are stored.

In the addresses "8A00–8BA3" of the RAM 140 accommodated in the IC card 116, as shown in FIG. 7B, data of the identification numbers of 20 sets of the electrophotographic copying machines and data of the copied quantity for each electrophotographic copying machine are stored. This means that one IC card 116 can be utilized in 20 sets of the electrophotographic copying machines 10 which have different identification number. In this case, if the data of the identification number being stored in the addresses "9A00–9A02" shown in FIG. 7A is coincident with the data of the identification number being stored in the addresses "8B7A–8B7C", the 19th electrophotographic copying machine 10 is registered in the IC card 116 as an electrophotographic copying machine capable of being used by the IC card 116. Then, for each completion of copy, the data in the addresses "9A03–9A14" of the RAM 124 is transferred and stored in the addresses "8B7D–8B8E" of the RAM 140. Data is the data to be confirmed in the mode of the aforementioned command number "C91".

Figure 8:
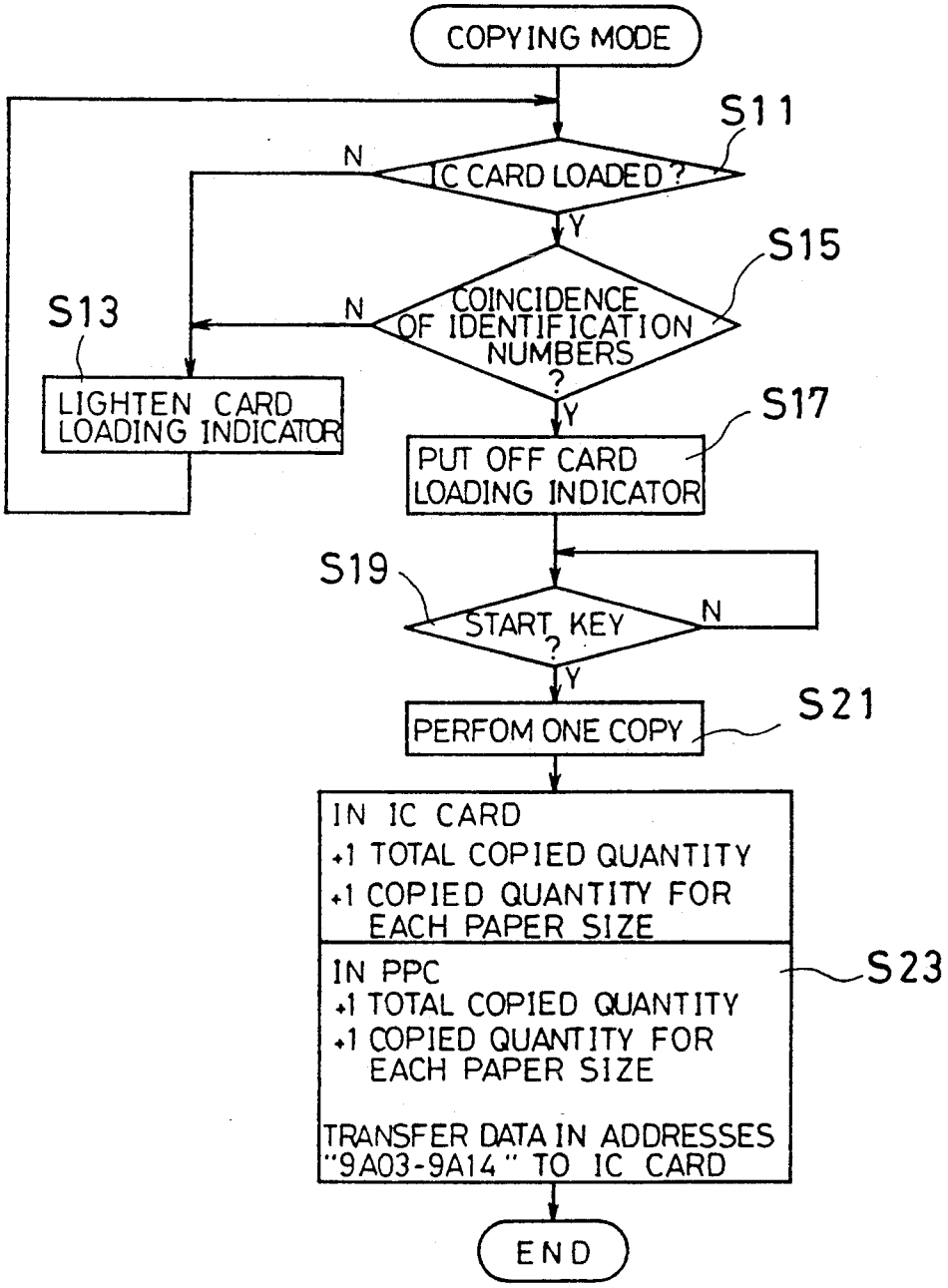
FIG. 8 is a flowchart showing an operation of the embodiment in a copying mode.

Next, with reference to FIG. 4, description will be made on operation or action of the electrophotographic copying machine 10 in the copying mode based upon a flowchart as shown in FIG. 8.

In FIG. 8, in the first step S11, it is determined whether or not the IC card 116 is loaded to the card receiving portion 118. More specifically, if the IC card 116 is loaded to the card receiving portion 118, the both connectors 136 and 138 are connected to each other such that the RAM 140 is connected to the MPU 120 via the bus. Therefore, the MPU 120 determines whether or not the RAM 140 is connected to the MPU 120 via the bus. If the IC card 116 has not been loaded in the step S13, the card loading indicator 112j is lightened, whereby the operator urged to load the IC card 116 or in the case where the IC card 116 has been loaded, if such a loading is incomplete, the operator is warned that the IC card 116 should be completely loaded to the card receiving portion 118.

If it is confirmed that the IC card 116 is completely loaded to the card receiving portion 118 in the step S11, the process proceeds to the step S15 where it is determined whether or not the identification number being registered in the addresses "9A00-9A02" of the RAM 124 and any one of the identification numbers being registered in the RAM 140 of the loaded IC card 116 are coincident with each other. As described above, it is possible to register the identification numbers of 20 sets of the electrophotographic copying machines in the IC card 116. Therefore, in this step S15, the MPU 120 determines whether or not the same data of the identification number as the data of the identification number of the addresses "9A00-9A02" exhibits in any addresses of the RAM 140. If coincidence of the identification numbers is not confirmed, the process proceeds to the step S13 and, if the identification numbers are coincident with each other, the process proceeds to the step S17. Therefore, even if the IC card 116 is completely loaded into the card receiving portion 118, when the identification number of the electrophotographic copying machine 10 has not been registered in the IC card 116, the card loading indicator **112*j* is lightened. Then, it is impossible to execute operation represented by the step S17** and thereafter, that is, copying operation.

If the coincidence of the identification numbers is confirmed in the step S15, in the step S17, the card loading indicator **112*j* is put out. Then, the process proceeds to the step S19, becoming a waiting state where operation of the start key 112*a*** is waited.

If operation of the start key **112*a* is confirmed in the step S19, that is, if a signal of the operation of the start key 112*a* is inputted to the MPU 120 through the key matrix 130 and the I/O interface 126, the process proceeds to the step S21 where the driving devices 134 are driven by the MPU 120 to execute one copy. If one copy is completed, the process proceeds to the next step S23**.

In this step S23, the data of the total copied quantity and the data of the copied quantity for each paper size stored in the RAMs 140 and 124 of the IC card 116 and the electrophotographic copying machine 10 are incremented by "1", respectively. Thus, the data of the addresses "8BA4-8BB5" and "9A03-9A14" of the RAMs 140 and 124 are renewed. Thereafter, the renewed data of the addresses "9A03-9A14" is transferred to predetermine addresses of the RAM 140 of the IC card 116 through the bus. For example, in the case where the identification number being registered in the addresses "9A00-9A02" and the identification number being registered in the addresses "8B7A-8B7C" of the RAM 140 are coincident with each other, the renewed data of the addresses "9A03-9A14" is transferred to the addresses "8B7D-8B8E". Thus, for each execution of copy, the data of the addresses "9A03-9A14" of the RAM 124 of the main unit 12 and the data of the addresses "8B7D-8B8E" of the RAM 140 of the IC card 116 are similarly renewed so as to hold the last copy data.

Next, with reference to FIG. 4, description will be made on operation or action of the electrophotographic copying machine 10 in the service mode based upon flowcharts as shown in FIG. 9A through FIG. 9G.

Figure 9A:
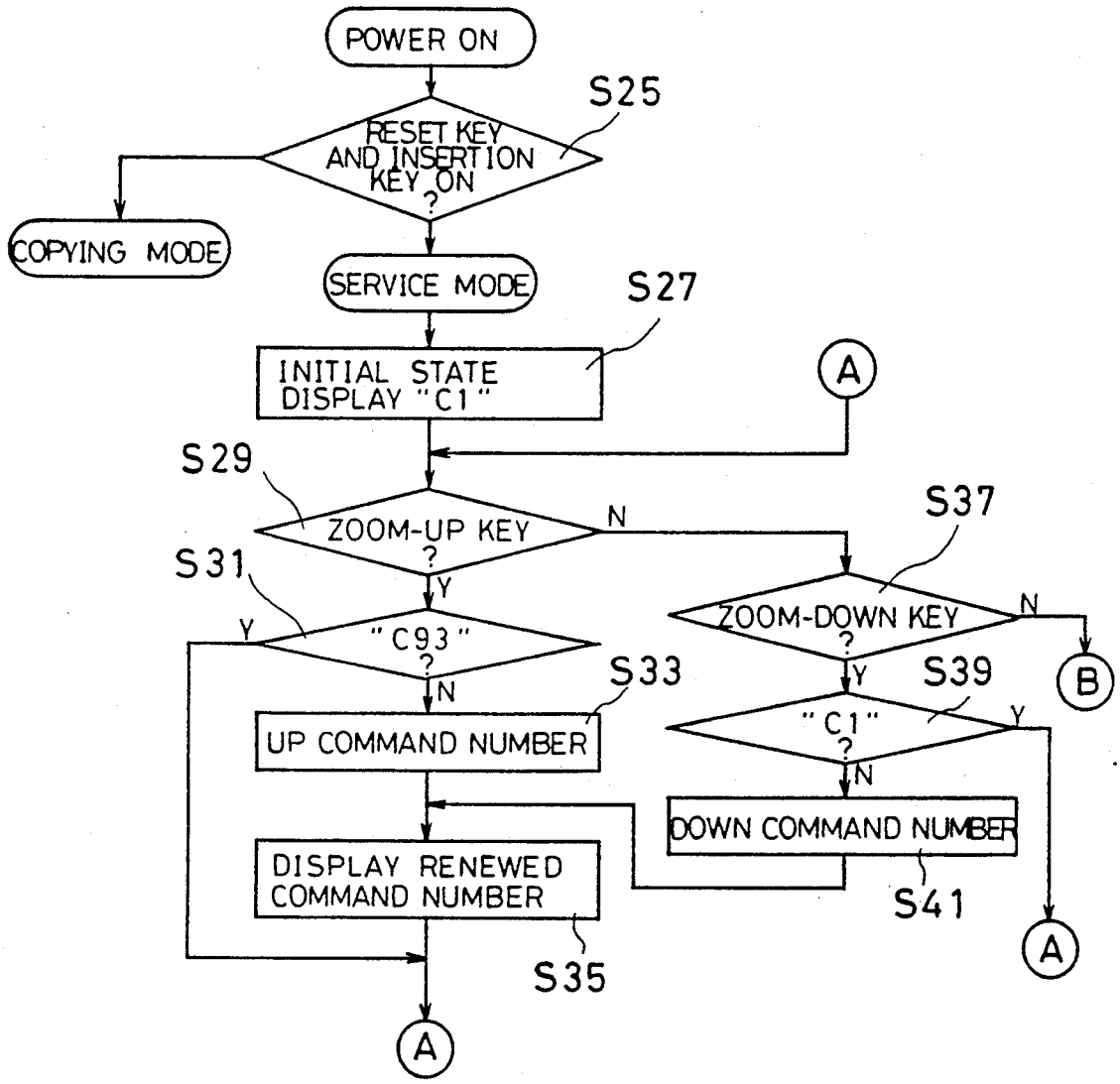
FIG. 9A through FIG. 9G are flowcharts showing an operation of the embodiment in a service mode.
Figure 9B:
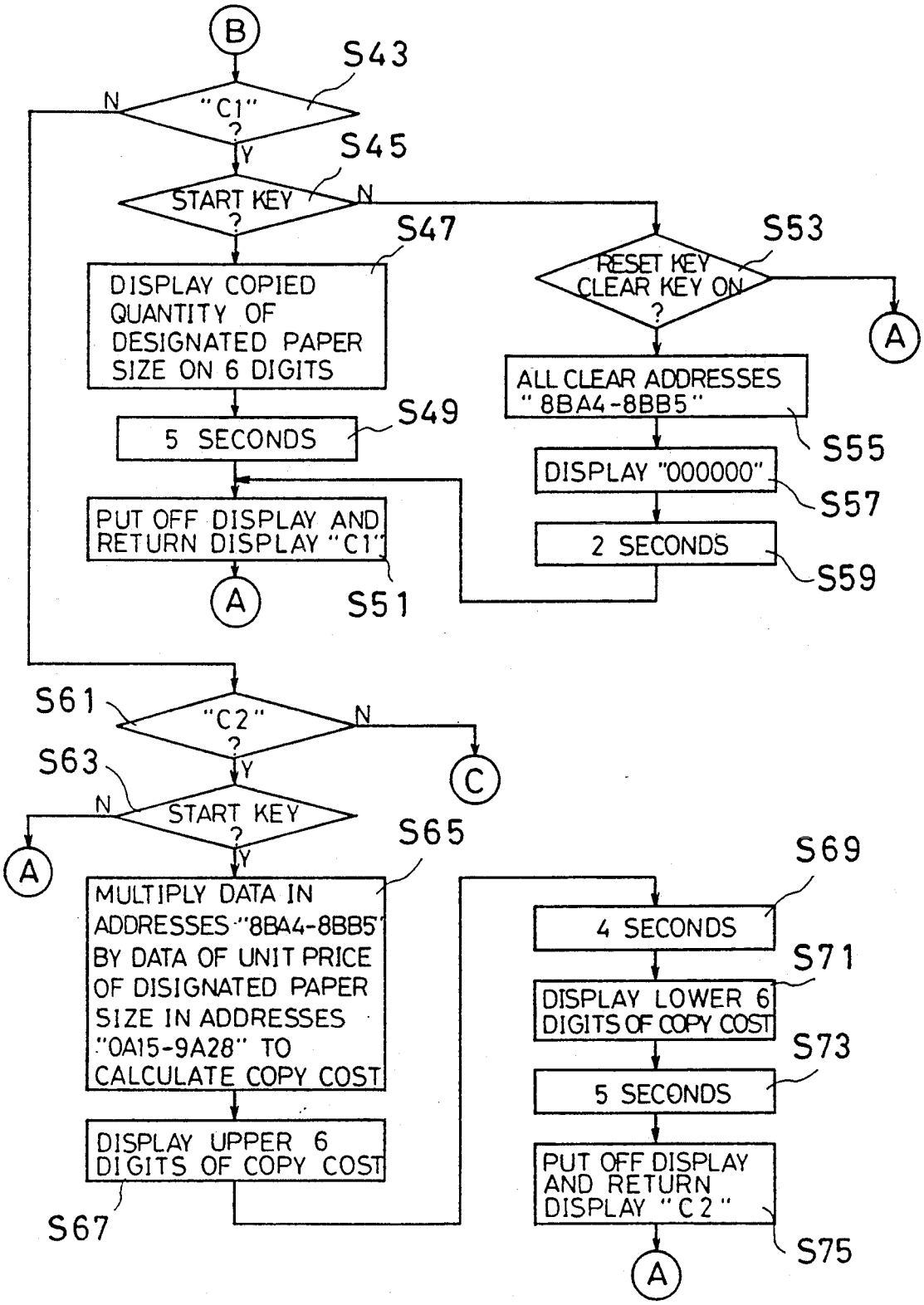
Figure 9C:
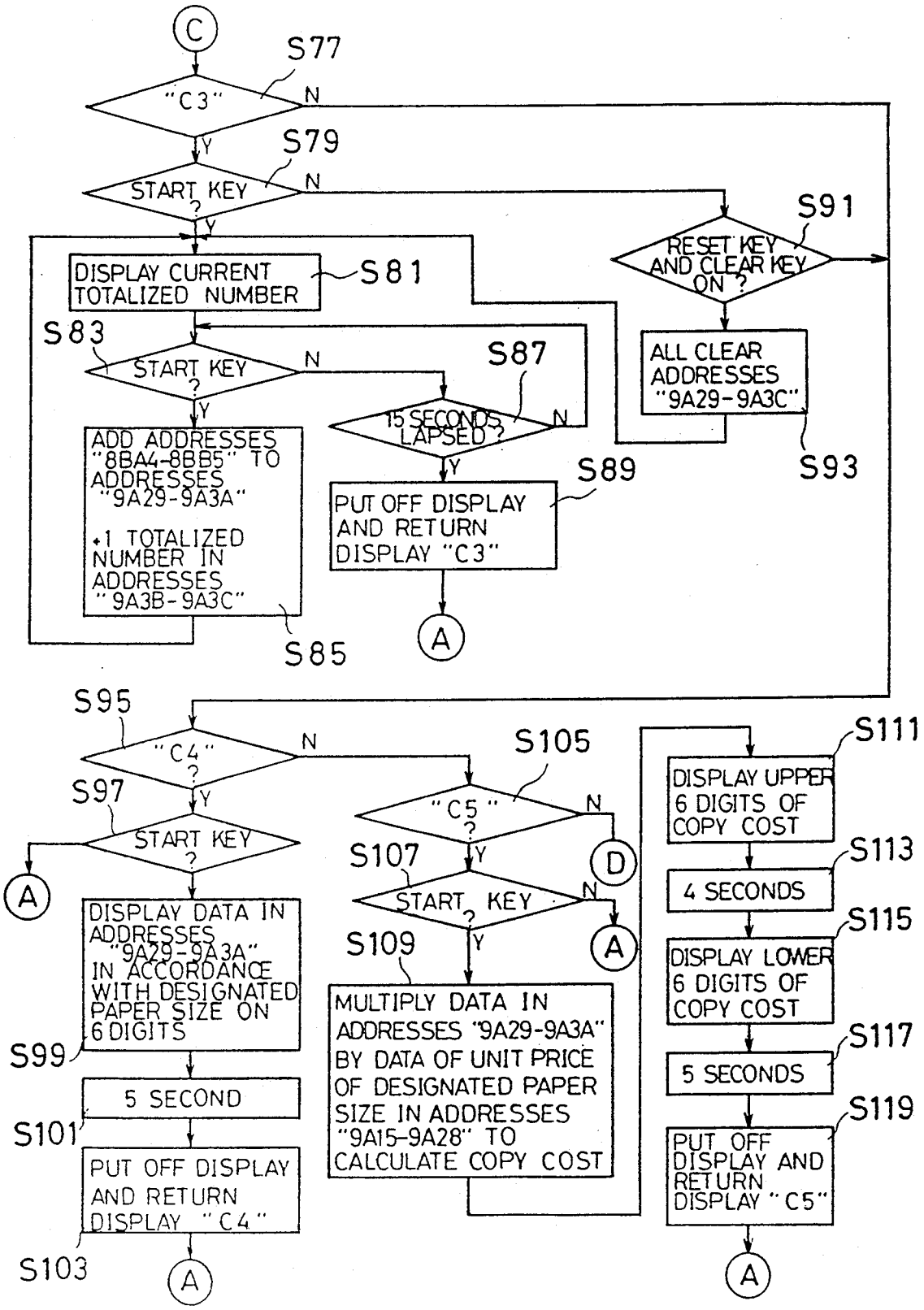
Figure 9D:
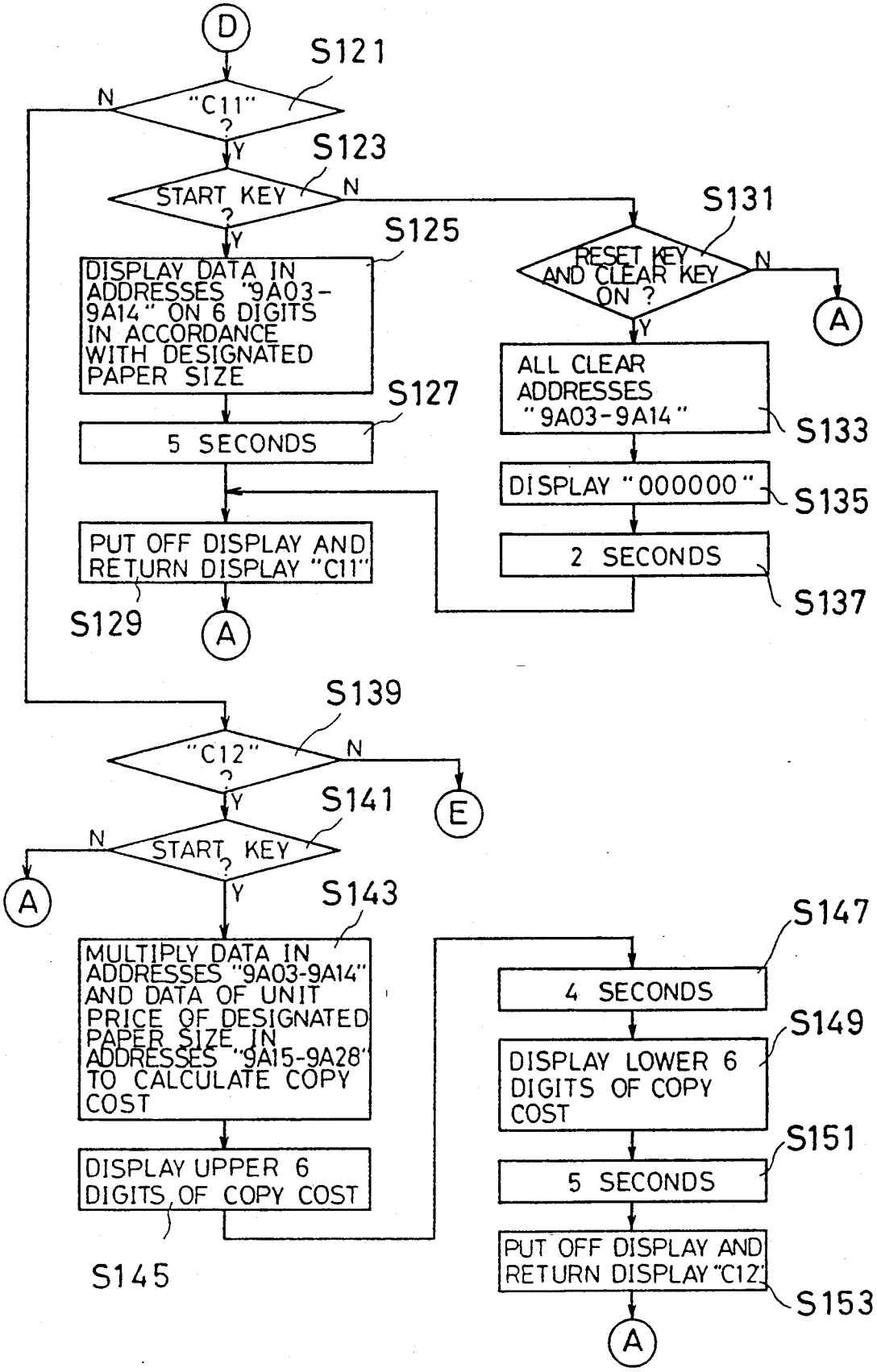
Figure 9E:
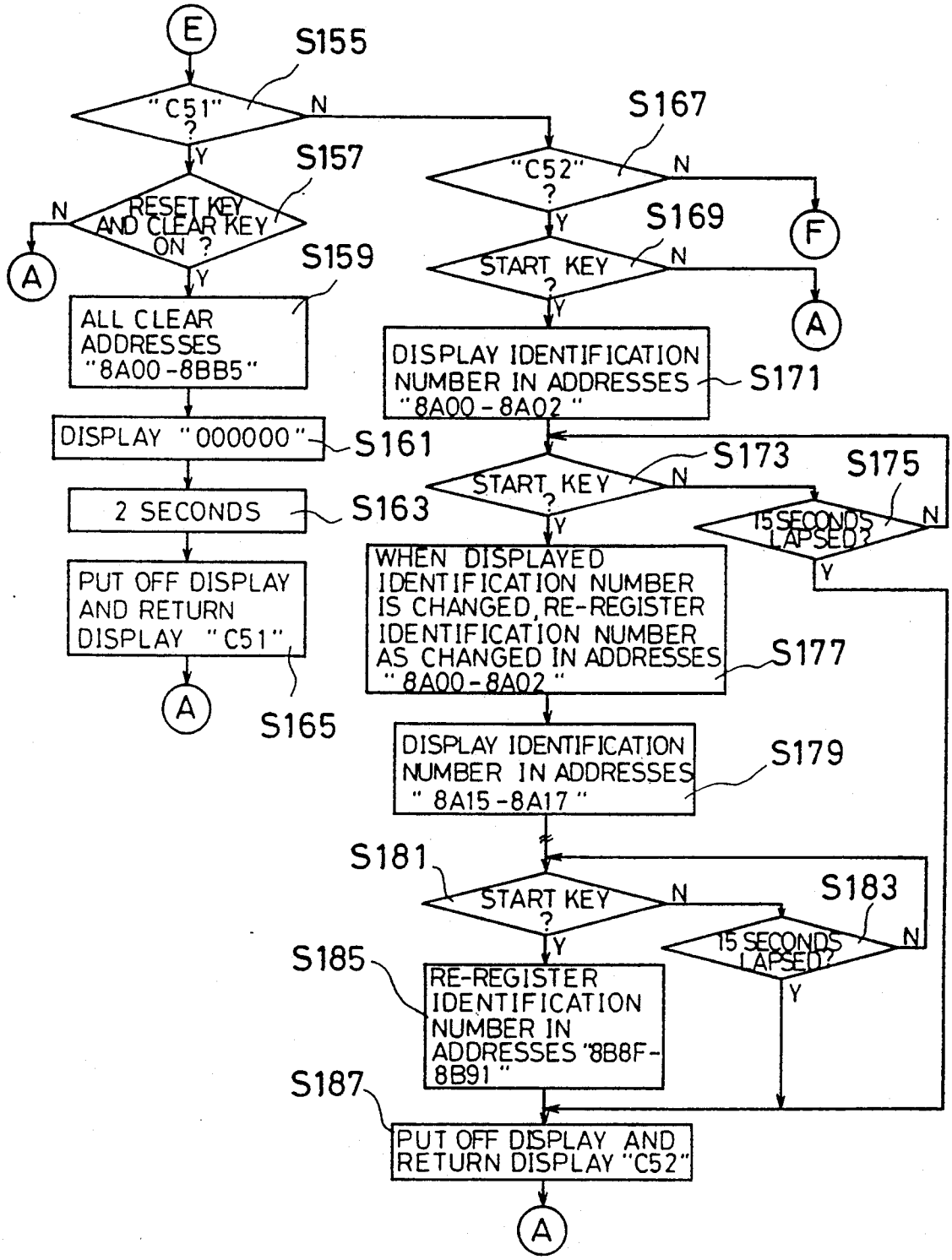
Figure 9F:
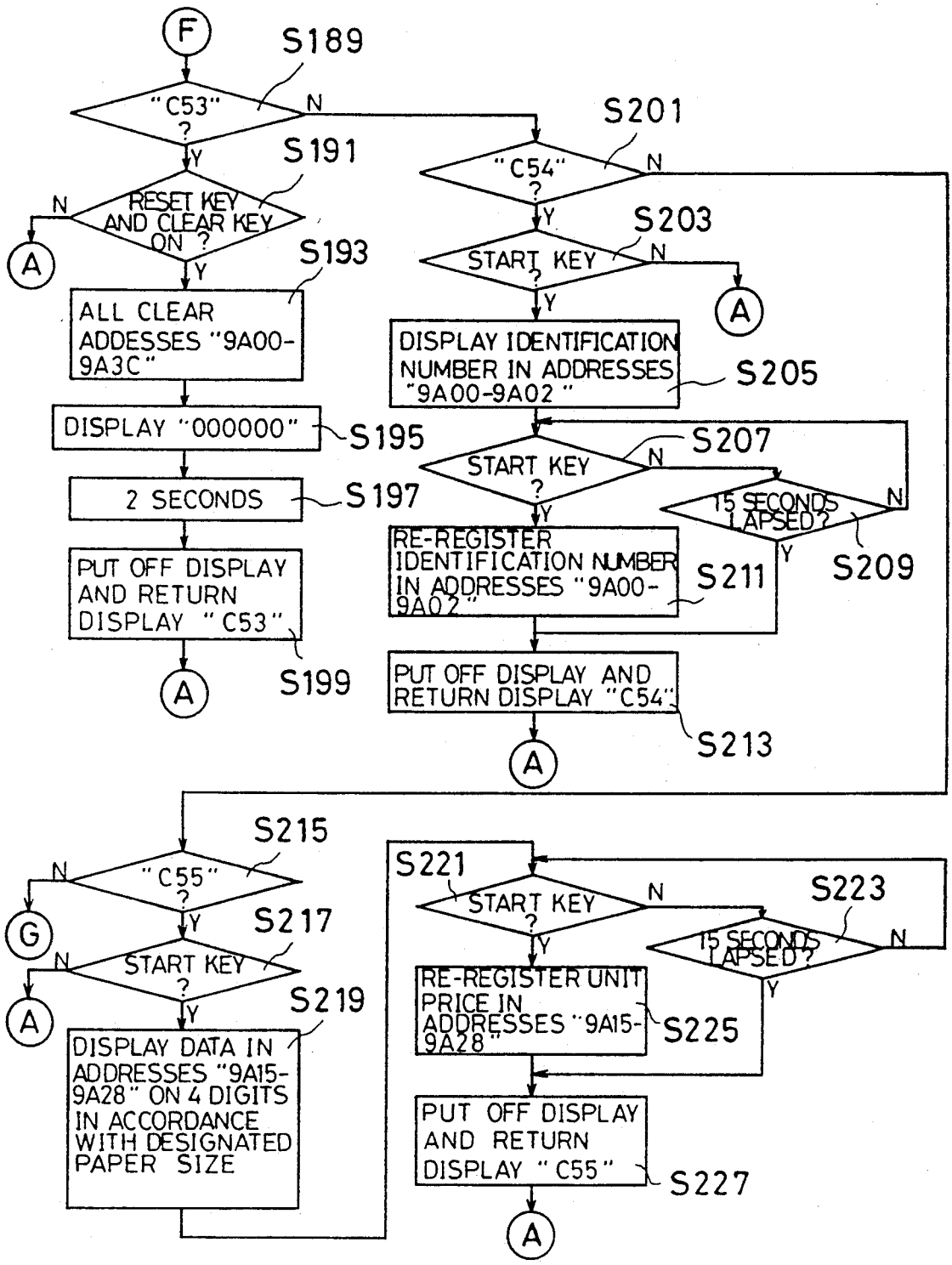
Figure 9G:
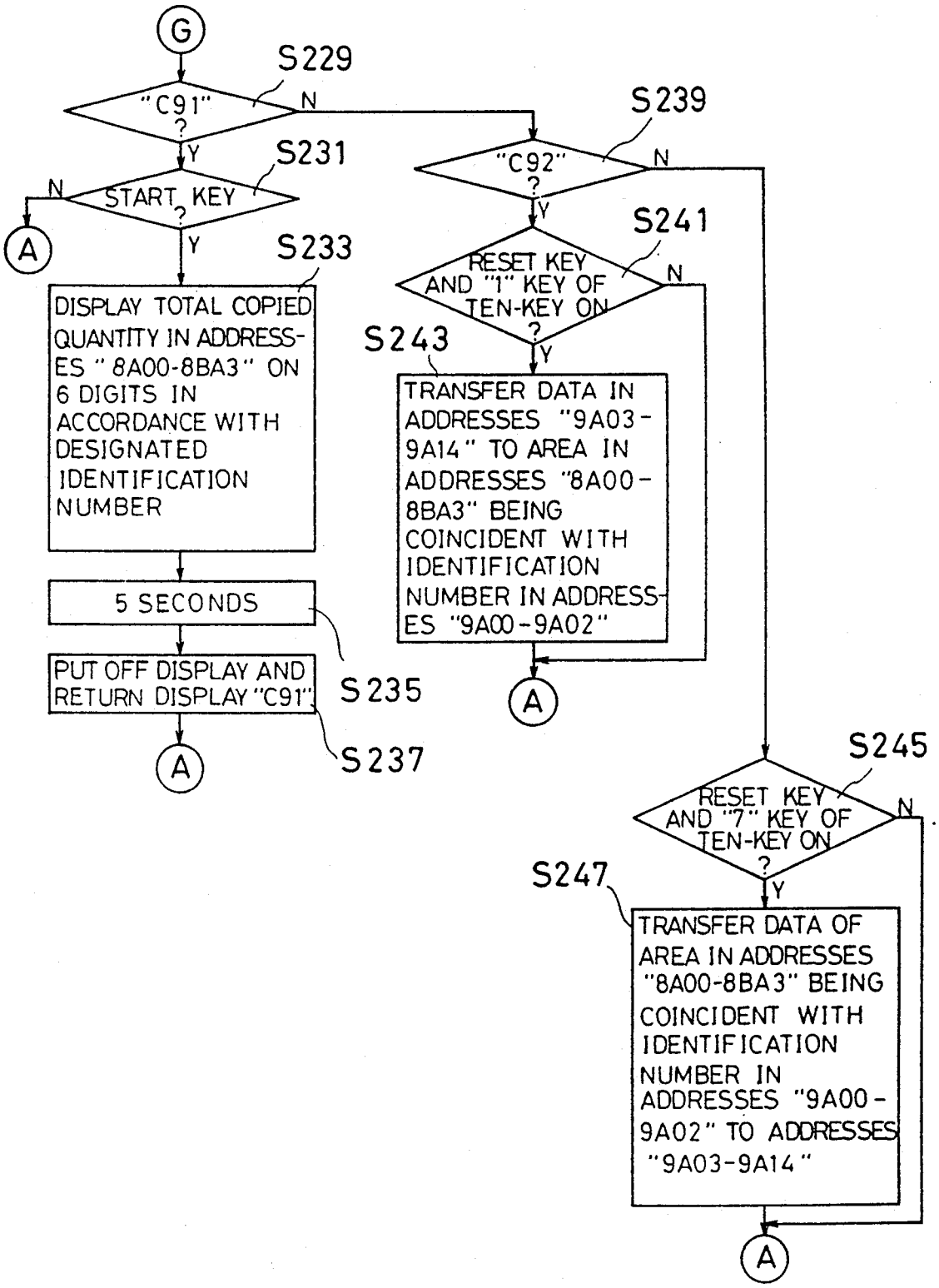

In the first step S25 shown in FIG. 9A, when the power switch is turned on, it is determined whether or not the reset key **112*b* and the insertion key 112*d* are simultaneously turned on. If the both keys 112*b* and 112*d* are not simultaneously operated, the electrophotographic copying machine 10 has not been changed in the service mode, that is, the electrophotographic copying machine 10** is maintained in the copying mode, and therefore, the process executes copying mode routine.

If the both keys **112*b* and 112*d* are simultaneously operated, the electrophotographic copying machine 10 is changed from the copying mode to the service mode. Then, as described above, various kinds of operation keys and displays or indicators in the operation panel 110** action on functions different from that of in the copy mode.

Figure 10A:
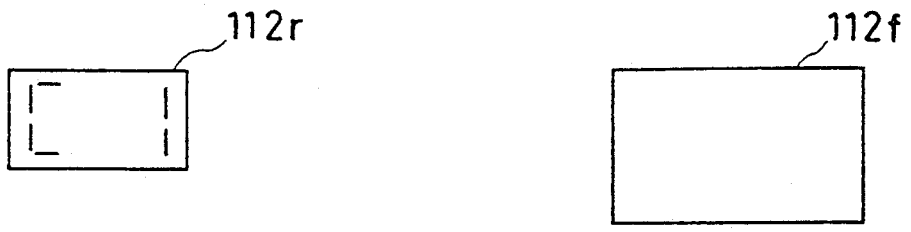
FIG. 10A through FIG. 10I are illustrative views showing respective states of a magnification display and a quantity display in the service mode.

Just after the electrophotographic copying machine 10 is changed to the service mode, in the step S27, the command number "C1" is displayed on the magnification display **112*r* as shown in FIG. 10A. The command number "C1" indicates an initial state of the service mode. Then, in the initial states, the displays or indicators in the operation panel 110, for example, the quantity display 112*f*, and etc. other than the magnification display 112** rare wholly put out.

In addition, since the magnification display **112*r* is numeral display of 3 digits each of which is 7 segments, displaying of the command number is performed by partially lightening the segments as shown in FIG. 10A-FIG. 10G**.

In the next step S29, it is determined whether or not the zoom-up key **112*p* is operated. If operated, the process proceeds to the step S31 where it is determined whether or not the command number is "C93" at this time. Then, if the command number is "C93", the process returns to the previous step S29. Therefore, if the command number "C93" is confirmed in the step S31, no change occurs in the command number even if zoom-up key 112*p*** is operated.

If it is confirmed that the command number is not "C93" in the step S31, the process proceeds to the step S33. For example, after the command number "C1" is displayed on the magnification display **112*r* in the previous step S27, the command number to be determined in the step S31 is, of course, "C1", and therefore, the process does not return to the step S29 and proceeds to the step S33**.

In the step S33, the command number is incremented. For example, if the command number is "C1" in the previous step S31, the command number is renewed as "C2". However, in the case where the command number is "C5" in the previous step S31, the command number is renewed as "C11" in the step S33, because the command number succeeding to "C5" is "C11" since as indicating in the previous table, the command numbers are 15 kinds from "C1" to "C93" including missing numbers.

In the next step S35, the command number which has been renewed in the previous step S33 is displayed on the magnification display **112*r*. Therefore, if the zoom-up key 112*p* is operated after displaying of the command number "C1" on the magnification display 112*r*, in this step S35, the command number "C2" is displayed on the magnification display 112*r***.

If operation of the zoom-up key **112*p* is not confirmed in the previous step S29, the process proceeds to the step S37 where it is determined whether or not the zoom-down key 112*q* is operated. If the zoom-down key 112*q* is operated, the process proceeds to the step S39. In the step S39, it is determined whether or not the command number at that time is "C1". If the command number is "C1", the process returns to the previous step S29. Therefore, if the command number has been "C1", no change occurs in the command number even if the zoom-down key 112q** is operated.

If it is not confirmed that the command number is "C1" in the step S39, the process proceeds to the step S41 where the current command number is decremented. For example, if the current command number is "C11", the command number is renewed as "C5" in this step S41. Thereafter, the process proceeds to the step S35 where the renewed command number "C5" is displayed on the magnification display 112r.

If operation of the zoom-down key 112q is confirmed in the step S37, the process proceeds to the step S43 where it is determined whether or not the current command number of the electrophotographic copying machine 10 is "C1". If the command number "C1" is confirmed, the process proceeds to the step S45.

In the step S45, it is determined whether or not the start key 112a is operated. If operation of the start key 112a is thus confirmed when the command number is "C1", the process proceeds to the step S47.

In the step S47, the data in the addresses "8BA-4-8BB5" of the RAM 140 of the loaded IC card 116 is displayed on 6 digits in total of the magnification display 112r and the quantity display 112f in response to operations of the paper size selecting key 120o and the equal magnification key 112n.

For example, when the operator wants to confirm the total copied quantity being performed by using the loaded IC card 116, the operator may operate the start key 112a in the state where the command number is "C1". Then, if the total copied quantity is, for example, "23,456" as shown in FIG. 10F, "23" of upper 3 digits is displayed on the magnification display 112r and "456" of lower 3 digits is displayed on the quantity display 112f. At this time, all of the LEDs of the paper size indicator 112l are lightened.

If the operator wants to confirm the copied quantity for each paper size, the operator operates the paper size selecting key 112o to designate a desired paper size. Then, only one LED representative of the designated paper size is lightened in the paper size indicator 112l and the copied quantity of the designated paper size is displayed on the magnification display 112r and the quantity display 112f.

In addition, the data of the total copied quantity performed by using the IC card 116 is stored or saved in 3 bytes of the addresses "8BA4-8BB5" of the RAM 140 as shown in FIG. 7B, and the data of the copied quantity for each paper size are also stored or saved in the respective addresses.

In the step S49, for confirmation by the operator, displaying as shown in FIG. 10F displayed in the previous step S47 is held by 5 seconds. Thereafter, if 5 seconds lapse, the process proceeds to the step S51 where displaying of the quantity display 112f and the paper size indicator 112l are put out and the command number "C1" is displayed on the magnification display 112r as shown in FIG. 10A. Then, the process returns to the step S29.

If operation of the start key 112a is not confirmed in the previous step S45, the process proceeds to the step S53 where it is determined whether or not the reset key 112b and the clear/stop key 112e are simultaneously operated. If not confirmed, the process returns the previous step S29 and if simultaneous operation is confirmed, the process proceeds the step S55.

In the step S55, the data in the addresses "8BA-4-8BB5" of the RAM 140 of the IC card 116 is cleared. The data is selectively displayed in the previous step S47, which are data representative of the total copied quantity and the copied quantity for each paper size by utilizing the IC card 116.

Figure 10B:
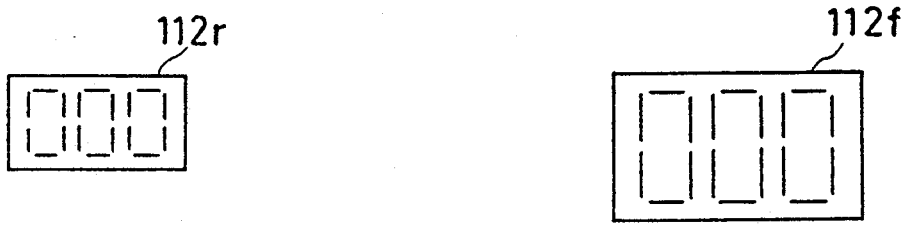

In the next step S57, as shown in FIG. 10B, "000000" is displayed on 6 digits in total of the magnification display 112r and the quantity display 112f. In the step S59, this displaying is held by 2 seconds. Thereafter, the process proceeds to the step S51, as similar to the case where the process proceeds from the step S49 to the step S51, as shown in FIG. 10A, displaying of the magnification display 112r returns "C1".

If it is not confirmed that the command number is "C1" in the previous step S43, the process proceeds to the step S61 where it is determined whether or not the mode of the command number "C2" is set.

If the command number "C2" is confirmed, the process proceeds to the step S63 where it is determined whether or not the start key 112a is operated. If operation of the start key 112a is not confirmed, the process returns to the previous step S29 and, if the operation is confirmed, the process proceeds to the step S65.

In the step S65, the copy cost with respect to the copied quantity being stored in the addresses "8BA-4-8BB5" of the RAM 140 of the IC card 116 is calculated. The copy cost for each paper size is calculated as set forth in the following. If the desired paper size is designated by the paper size selecting key 112o, the unit price of the designated paper size is read from the addresses "9A15-9A28" of the RAM 124 and the data associated with the copied quantity is read from the addresses "8BA4-8BB5" of the RAM 140 of the IC card 116, and the both data are multiplied with each other so as to calculate the copy cost for each designated paper size.

In addition, when the total copy cost is to be calculated by operating the equal magnification key 112n, the copy costs for each paper size are calculated and totalized to evaluated the total copy cost.

Figure 10C:
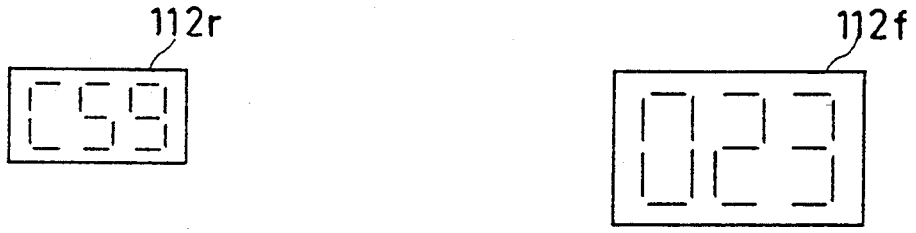
Figure 10D:
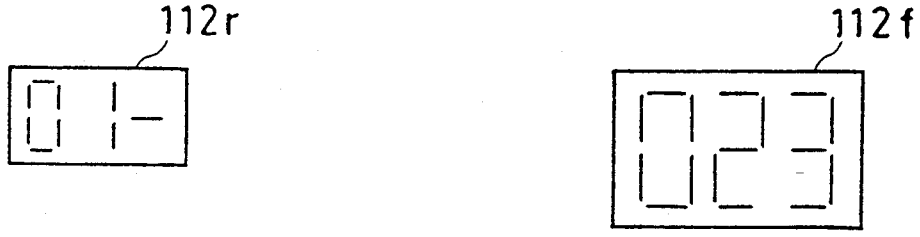
Figure 10E:
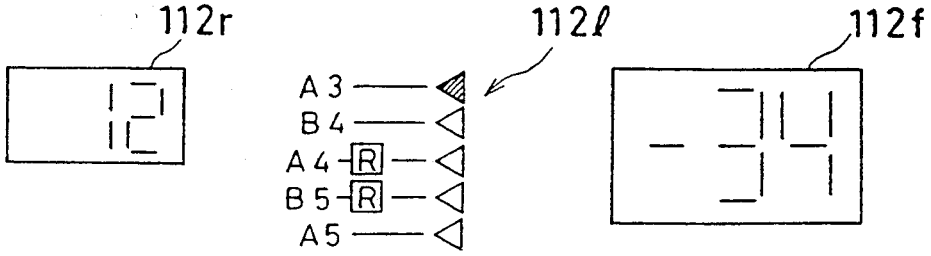
Figure 10F:
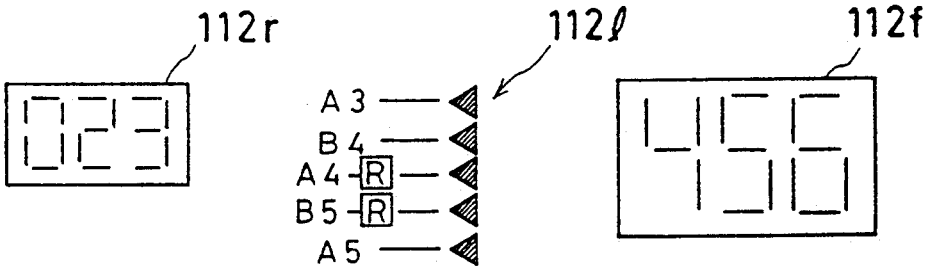
Figure 10G:
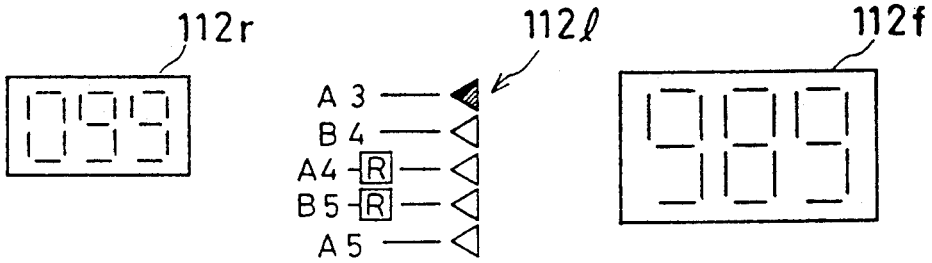
Figure 10H:
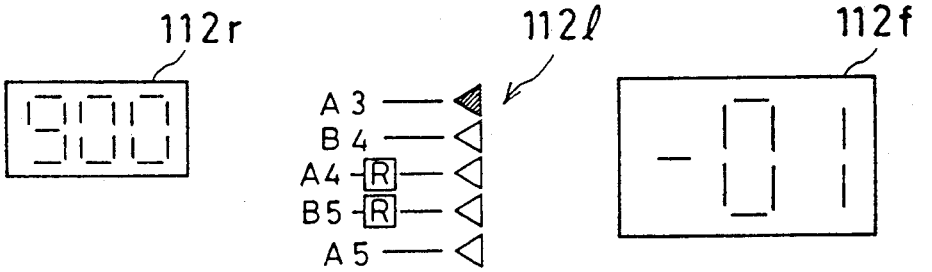

In the next step S67, 6 digits of the amount of the copy cost calculated in the previous step S65 is first displayed. In this embodiment shown, since the magnification display 112r and the quantity display 112f respectively include the number of digits smaller than necessary number of digits for displaying the copied quantity, the copy cost and etc., the numeral value having larger number of digits such as copy cost is displayed in a time-shared fashion. For example, the maximum unit price of the copy cost capable of being set is "99 yen 99 sen" and the largest value of the total copied quantity is "999999". Therefore, the largest value of the copy cost as calculated becomes "999899900 yen 01 sen" of 10 digits. Therefore, it is impossible to display at once the numeral value of this 10 digits on 6 digits in total of the magnification display 112r and the quantity display 112f. Therefore, in such a case, as shown in FIG. 10G, "099989" of upper 6 digits is, first, displayed in the step S67, and thereafter, displaying of the upper 6 digits is held by 4 seconds in the step S69, and then, "900-01" of lower 6 digits is displayed as shown in FIG. 10H in the step S71. The sign "—" represents that the right 2 digits are digits for displaying "sen". Thus, by performing displaying in the respective step S67 and the step S71 in a time-shared fashion, it becomes possible to display the copy cost of 10 digits on the digits smaller than that of the same. In addition, displaying of the step S71 is held by 5 seconds in the step S73. Thereafter, 5 seconds lapse, the command number "C2" is displayed again on the magnification display 112r in the step S75, and the process returns to the step S29.

If it is determined that the command number is not "C2" in the previous step S61, the process proceeds to the step S73 where it is determined whether or not the command number is "C3". If the command number "C3" is not confirmed, the process proceeds to the step S95 and, if confirmed, the process proceeds to the step S79.

In the step S79, it is determined whether or not the start key 112a is operated. If operation of the start key 112a is determined, the process proceeds to the step S81 where the copied quantity of the IC card 116 as totalized is displayed. This displaying can be performed by reading the data in the addresses "9A3B-9A3C" of the RAM 124 and displaying the same on the quantity display 12f.

Figure 10I:
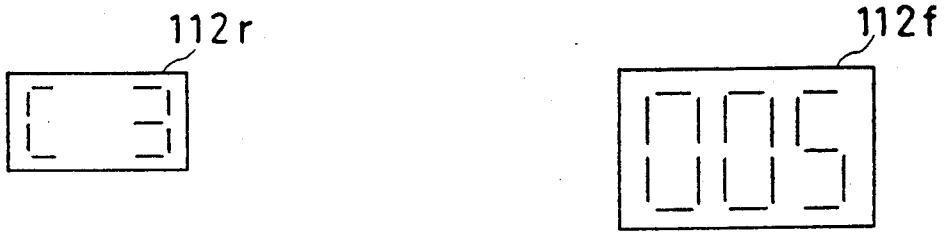

In the next step S83, it is determined whether or not the start key 112a is operated again. If operation of the start key 112a is confirmed, the process proceeds to the step S85 where the data in the addresses "8BA4-8BB5" of the RAM 140 of the IC card 116 is added to the data of the copied quantity being stored in the addresses "9A29-9A3A" of the RAM 124. Thereafter, the data in the addresses "9A3B-9A3C" is incremented by "1". In addition, in this embodiment shown, the number if the IC cards 116 data of which can be totalized is "999" at the largest. One example of displaying when five IC cards 116 are totalized in the step S81 is shown in FIG. 10I.

Operation of the start key 112a is not confirmed in the step S83, the process proceeds the step S87 where it is determined whether or not 15 seconds lapse from the timing when the process proceeds from the step S81 to the step S83. Then, if 15 seconds lapse, the process proceeds to the step S89 where displaying on the quantity display 112f as shown in FIG. 10I being displayed in the step S81 is put out and the command number "C3" is displayed on the magnification display 112r.

If operation of the start key 112a is not confirmed in the previous step S79, the process proceeds to the step S99 where it is determined whether or not the reset key 112b and the clear/stop key 112e are simultaneously operated in the mode set by the command number "C3". If simultaneous operation is confirmed, the process proceeds to the step S93. In the step S93, data in the addresses "9A29-9A3C" of the RAM 124, that is, the data representative of the copied quantity for each paper size being totalized for a plurality of IC cards 116, the data representative of the total copied quantity and the data of the number of the IC cards 116 being totalized are cleared. Therefore, if the process is brought in the step S81 by passing the step S93, in the step S81, "000" is displayed on the quantity display 112f.

If simultaneous operation of the reset key 112b and the clear/stop key 112e is not confirmed in the previous step S91, the process proceeds to the step S95 where it is determined whether or not the command number is "C4". If the command number is "C4", the process proceeds to the step S97 where it is determined whether or not the start key 112a is operated. If operation of the start key 112a is not confirmed, the process returns to the step S29 and, if confirmed, the process proceeds to the step S99.

In the step S99, the data of the designated paper size is read from the addresses "9A29-9A3A" of the RAM 124 to which the data in the addresses "8BA4-8BB5" of the RAM 140 of the IC card 116 has been added in the previous step S85 is displayed on 6 digits in total of the magnification display 112r and the quantity display 112f as similar to the previous step S47. Thereafter, this displaying is held by 5 seconds in the step S101, and when 5 seconds has lapsed, the command number "C4" is displayed again on the magnification display 112r in the step S103.

If it is not determined that the command number is "C4" in the previous step S95, the process proceeds to the step S105 where it is determined whether or not the command number is "C5". If the command number "C5" is confirmed, the process proceeds to the step S107 where it is determined whether or not the start key 112a is operated.

If operation of the start key 112a is not confirmed in the step S107, the process returns to the step S29 and, if confirmed, the process proceeds to the step S109.

In the step S109, as similar to the previous step S65, the copy cost of the designated paper size is calculated. More specifically, if the paper size is designated by the paper size selecting key 112o, data in the addresses "9A29-9A3A" and "9A15-9A28" of the RAM 124 are read and multiplied with each other so as to calculate the copy cost of the designated paper size.

In the next steps S111-S117, as similar to the previous step S67-S73, the copy cost as calculated in the step S109 is displayed on the magnification display 112r and the quantity display 112f in a time-shared fashion. Thereafter, in the step S119, the command number "C5" is displayed again on the magnification display 112r.

If the command number "C5" is not confirmed in the previous step S105, the process proceeds to the step S121 where it is determined whether or not the command number is "C11". Then, if the command number "C11" is confirmed, in the step S123, it is determined whether or not the start key 112a is operated. If operation of the start key 112a is confirmed, the process proceeds to the step S125.

In the step S125, as similar to the step S47, the data in the addresses "9A03-9A14" of the RAM 124 is read for each paper size, and the copied quantity for each paper size and the total copied quantity are displayed. Thereafter, this displaying is held by 5 seconds in the step S127, and when 5 seconds has lapsed, in the step S129, the command number "C11" is displayed again on the magnification display 112r. Thereafter, the process returns to the step S29.

If operation of the start key 112a is not confirmed in the previous step S123, the process proceeds to the step S131 where the reset key 112b and the clear/stop key 112e are simultaneously operated in the state of the command number "C11".

If simultaneous operation is not confirmed, the process returned to the step S29 and, if confirmed, the process proceeds to the step S133.

In the step S133, the data in the addresses "9A03-9A14" of the RAM 124 is cleared. Thereafter, as shown in FIG. 10B, "000000" is displayed on 6 digits in total of the magnification display 112r and the quantity display 112f in the step S135. Then, displaying of the step S135 is held by 2 seconds in the step S137, and the process returned to the step S129 where the command number "C11" is displayed again on the magnification display 112r, and thereafter, the process returned to the step S29.

If the command number "C11" is not confirmed in the previous step S121, the process proceeds to the step S139 where it is determined whether or not the command number is "C12".

If it is confirmed that the command number is "C12", the process proceeds to the step S141 where it is determined whether or not the start key 112a is operated. If operation of the start key 112a is not confirmed, the process returned to the step S29 and, if confirmed, the process proceeds to the step S143.

In the step S143, as similar to the step S109, the data in the addresses "9A03-9A14" and "9A15-9A28" are read in accordance with the designated paper size and the same are multiplied with each other so as to evaluate the copy cost of the designated paper size. More specifically, in the step S143, the copy cost for each paper size and the total copy cost executed by this electrophotographic copying machine are calculated. Thereafter, in the steps S145-S151, as similar to the previous step S109-S117, the copy cost as calculated in the step S143 is displayed in a time-shared fashion. Thereafter, in the step S153, the command number "C12" is displayed again on the magnification display 112r, and the process returned to the step S29.

If the command number "C12" is not confirmed in the previous step S139, the process proceeds to the step S155 where it is determined whether or not the command number is "C51". If the command number is "C51", the process proceeds to the step S157 where it is determined whether or not the reset key 112b and the clear/stop key 112e are simultaneously operated. If simultaneous operation is not confirmed, the process returned to the step S29 and, if confirmed, the process proceeds to the step S159.

In the step S159, the data in the addresses "8A0-0-8BB5" of the RAM 140 of the IC card 116 is cleared. Thereafter, in the step S161, "000000" is displayed on the magnification display 112r and the quantity display 112f as shown in FIG. 10B. This displaying is held by 2 seconds in the next step S163, and when 2 seconds has lapsed, such displaying is put out and, in the step S165, the command number "C51" is displayed again on the magnification display 112r and then the process returned to the step S29.

If the command number "C51" is not confirmed in the step S155, the process proceeds to the step S167 where it is determined whether or not the command number is "C52". If the command number "C52" is confirmed in the step S167, the process proceeds to the step S169 where it is determined whether or not the start key 112a is operated. If operation of the start key 112a is not confirmed, the process returned to the step S29 and, if confirmed, the process proceeds to the step S171.

In the step S171, the data being stored or saved in the addresses "8A00-8A02" of the RAM 140 of the IC card 116, that is, the identification number is displayed on the quantity display 112f. Thereafter, the process proceeds to the step S173 where it is determined whether or not the start key 112a is operated again. If operation of the start key 112a is not confirmed, the process proceeds to the step S175 where it is determined whether or not 15 seconds has lapsed from the timing when the identification number is displayed in the step S171. If 15 seconds has lapsed, the process proceeds to the step S187 where the identification number being displayed in the step S171 is put out and the command number "C52" is displayed again on the magnification display 112r.

If operation of the start key 112a is confirmed in the step S173, the process proceeds to the step S177. In the step S177, in the case where the identification number displayed in the previous step S171 is changed, that is, in the case where the new identification number is set and displayed on the quantity display 112f by operating the ten-key 112c, the data of the set identification number is re-registered in the addresses "8A00-8A02" of the RAM 140 of the IC card 116.

In the next step S179, the identification number being stored in the addresses "8A15-8A17" of the RAM 140 of the IC card 116, that is, the identification number being registered for the second electrophotographic copying machine is displayed on the quantity display 112f. As described above, identification numbers of 20 sets of the electrophotographic copying machines 10 can be registered in one IC card 116. Then, the identification number of the first electrophotographic copying machine is displayed in the step S171, and the identification number of the second electrophotographic copying machine is displayed in the step S179. Therefore, identification numbers from the third electrophotographic copying machine to the 19th electrophotographic copying machine can be displayed on the quantity display 112f by operating the start key 112a in plurality of times in accordance with the number of sets of the electrophotographic copying machines.

In the step S181, it is determined whether or not the start key 112a is operated. If operation of the start key 112a is not confirmed, the process proceeds to the step S183 where it is determined whether or not 15 seconds lapse. Then, after displaying the identification number of 19th electrophotographic copying machine, when 15 seconds has lapsed, the process proceeds from the step S183 to the step S187 where the identification number is put out and the command number "C52" is displayed again on the magnification display 112r, and the process returns to the step S29.

If operation of the start key 112a is confirmed in the step S181, when the identification number of 20th electrophotographic copying machine is set, the newly set identification number is re-registered in the addresses "8B8F-8B91" of the RAM 140 of the IC card 116, and the command number "C52" is displayed again in the step S187.

If the command number "C52" is not confirmed in the previous step S167, the process proceeds to the step S189 where it is determined whether or not the command number is "C53". If the command number "C53" is confirmed, the process proceeds to the step S191 where it is determined whether or not the reset key 112c and the clear/stop key 112e are simultaneously operated. If simultaneous operation is not confirmed, the process returns to the step S29 and, if confirmed, the process proceeds to the step S193.

In the step S193, as similar to the time when the data in the addresses "8A00-8BB5" of the RAM 140 of the IC card 116 is cleared in the previous step S159, the data in the addresses "9A00-9A3C" of the RAM 124 is cleared. Thereafter, the process proceeds to the step S195 where "000000" is displayed on the magnification display 112r and the quantity display 112f. This displaying is held by 2 seconds in the step S197. Then, when the process proceeds to the step S199, such displaying is put out and the command number "C53" is displayed again on the magnification display 112r, and the process returns to the step S29.

If the command number "C53" is not confirmed in the step S189, the process proceeds to the step S201 where it is determined whether or not the command number is "C54". If the command number "C54" is confirmed, in the next step S203, it is determined whether or not the start key 112*a* is operated. If operation of the start key 112*a* is confirmed, the process proceeds to the step S205 where the data in the addresses "9A00-9A02" of the RAM 124, that is, the identification number of the electrophotographic copying machine 10 itself is displayed on the quantity display 112*f*. For example, when this identification number is "023", displaying on the magnification display 112*r* and the quantity display 112*f* becomes as shown in FIG. 10C.

In the next step S203, it is determined whether or not the start key 112*a* is operated again. If operation of the start key 112*a* is not confirmed, the process proceeds to the step S209 where it is determined whether or not 15 seconds has lapsed from the timing when the identification number is displayed. When 15 seconds has lapsed, in the step S213, displaying of the identification number is put out and the command number "C54" is displayed again on the magnification display 112*r*. Then, the process returned to the step S29.

If operation of the start key 112*a* is confirmed in the step S207, when the identification number displayed in the previous step S205 is changed by the ten-key 112*c*, renewal of the identification number is performed and the renewed identification number is re-registered in the addresses "9A00-9A02" of the RAM 124.

If the command number "C54" is not confirmed in the previous step S201, the process proceeds to the step S215 where it is determined whether or not the command number is "C55". If the command number "C55" is confirmed, the process proceeds to the step S217 where it is determined whether or not the start key 112*a* is operated. If operation of the start key 112*a* is confirmed, the process proceeds to the step S219 where the data in the addresses "9A15-9A28" of the RAM 124, that is, unit price for each paper size is displayed on the magnification display 112*r* and the quantity display 112*f*. For example, when the unit price of A3 size is "12 yen 34 sen", as shown in FIG. 10E, the LED representative of "A3" is lightened in the paper size indicator 112*l*, and "12" is displayed on the magnification display 112*r* and "−34" is displayed on the quantity display 112*f*. The sign "−" shows that the light two digits are the value of the digit of "sen". In addition, in the case where the start key 112*a* is operated in the step S217 without operating the paper size selecting key 112*o*, the unit price being displayed is one of A3 size.

If the unit price being registered should be changed, a new unit price is set and displayed on the magnification display 112*r* and the quantity display 112*f* by operating the ten-key 112*c* and the clear/stop key 112*e*.

Next, in the step S221, it is determined whether or not the start key 112*a* is operated. If not confirmed, in the next step S223, it is determined whether or not 15 seconds has lapsed from the timing when the unit price is displayed. When 15 seconds has lapsed, the process proceeds to the step S227 where displaying of the unit price is put out and the command number "C55" is displayed again on the magnification display 112*r*, and then the process returns to the step S29.

More specifically, if operation of the start key 112*a* is confirmed, the process proceeds to the step S225 where the changed or renewed unit price is re-registered in the addresses "9A15-9A28" of the RAM 124. Then, the command number "C55" is displayed again on the magnification display 112*r*.

The command number "C55" is not confirmed in the previous step S215, the process proceeds to the step S229 where it is determined whether or not the command number is "C91". If the command number "C91" is confirmed, the process proceeds to the step S231 where it is determined whether or not the start key 112*a* is operated. If operation of the start key 112*a* is not confirmed, the process returns to the step S29 and, if confirmed, the process proceeds to the step S233.

In the step S233, the total copied quantity of the electrophotographic copying machine having the identification number being designated by the ten-key 112*c*, which is recorded in the addresses "8A00-8BA3" of the RAM 140 of the IC card 116, is displayed. In addition, inputting of the identification number is executed before the step S231. The total copied quantity is displayed on 6 digits in total of the magnification display 112*r* and the quantity display 112*f*. Then, this displaying is held by 5 seconds in the step S235, and thereafter, the process proceeds to the step S237 where displaying is put out and the command number "C91" is displayed again on the magnification display 112*r*, and the process returns to the step S29.

The command number "C91" is not confirmed in the previous step S229, the process proceeds to the step S239 where it is determined whether or not the command number is "C92". If the command number "C92" is confirmed, in the step S241, the reset key 112*b* and the "1" key of the ten-key 112*c* are simultaneously operated. If simultaneous operation is not confirmed, the process returns to the step S29 and, if confirmed, the process proceeds to the step S243.

In the step S243, the data in the addresses "9A03-9A14" out of the data in the addresses "8A00-8BA3" of the RAM 140 in the IC card 116 is transferred to area having the identification number coincident with the data, i.e. the identification number in the addresses "9A00-9A02" of the RAM 124. Therefore, the data of a portion where the same identification number as the electrophotographic copying machine 10 is registered in the data of the IC card 116 which is loaded into the electrophotographic copying machine can be renewed.

If it is not confirmed that the command number is "C92" in the step S239, the remaining command number is "C93". Therefore, the process proceeds to the step S245 where it is determined whether or not the reset key 112*b* and the "7"key of the ten-key 112*c* are simultaneously operated. If simultaneous operation is not confirmed, the process returns to the step S29 and, if confirmed, the process proceeds to the step S247.

In the step S247, the data of area having the same identification number as the identification number in the addresses "9A00-9A02" of the RAM 124 out of the data in the addresses "8A00-8BA3" of the RAM 140 of the IC card 116 is transferred from the IC card 116 to the addresses "9A03-9A14" of the RAM 124. In the case where the control circuit board should be exchanged, since it is afraid that the data being saved in the RAM 124 of the electrophotographic copying machine 10 will be burnished, it is necessary to transfer the data from the RAM 124 to the RAM 140 of the IC card 116, and after completion of exchanging the control circuit board, the data is retransferred to the RAM 124 from the RAM 140. The mode set by the command number "C93" is effectively utilized in such operation or action for exchanging the control circuit board.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying machine, comprising:

a memory card provided with memory means to which copy management data for management of a copy by an electrophotographic copying machine is stored;

a card loading portion for loading said memory card;

mode setting means for setting said electrophotographic copying machine selectively in one of a first mode and a second mode;

a plurality of keys for setting a copying condition;

a display;

first display data applying means for applying said copying condition which is set through an operation of said plurality of keys to said display when said first mode is set by said mode setting means;

second display data applying means for applying said copy management data which is stored in said memory means of said memory card to said display when said second mode is set by said mode setting means, wherein said display displays said copying condition in said first mode and said copy management data in said second mode, respectively; and totalizing means for totalizing copy management data being stored in a plurality of said memory cards, said second display data applying means including means for applying a totalization result by said totalizing means to said display.

2. An electrophotographic copying machine in accordance with claim 1, wherein said mode setting means includes at least two keys of said plurality of keys, said at least two keys being operated at substantially the same time for setting said second mode.

3. An electrophotographic copying machine in accordance with claim 2, wherein said at least two keys include a reset key and an insertion copy key.

4. An electrophotographic copying machine in accordance with claim 2, wherein said second display data applying means includes display changing means for changing a display content of said copy management data on said display, said display changing means including at least one key of said plurality of keys.

5. An electrophotographic copying machine in accordance with claim 1, further comprising data writing means for writing the last copy management data in said memory means of said memory card for each execution of copy.

6. An electrophotographic copying machine in accordance with claim 1, where said copy management data includes data indicative of at least one of an identification number of the machine, total copied quantity, copied quantity for each paper size, unit price, total copied quantity totalized with respect to all memory cards and copied quantity for each paper size totalized with respect to all memory cards, and said memory storing at least one said identification data by which it becomes possible to use at least one electrophotographic copying machine further comprising:

writing means for writing said copy management data in said memory of said memory card after a copying operation performed according to said copying condition in said first mode when said second mode is set by said mode setting means, said copy management data being written in a storage region associated with said identification number.

7. An electrophotographic copying machine in accordance with claim 1, wherein said display displays said copy management data when said copy management data is written in said memory of said memory card by a writing means.

8. An electrophotographic copying machine, in accordance with claim 1, further comprising:

a first memory for storing copy management data for management of a copy by an electrophotographic copying machine, said copy management data including at least one of a total copied quantity, copied quantity for each paper size, unit price, total copied quantity totalized with respect to all memory cards and copied quantity for each paper size totalized with respect to all memory cards;

said memory means of said memory card having a second memory for storing copy management data for management of a copy by an electrophotographic copying machine, said copy management data including data indicative of at least one of an identification number of the machine, total copied quantity, copied quality for each paper size, unit price, total copied quantity totalized with respect to all memory cards;

means for commanding a transfer of said copy management data between said first memory and said second memory; and means for transferring at least one of said copy management data from said first memory to said second memory and for transferring the copy management data from said second memory to said first memory.

9. An electrophotographic copying machine in accordance with claim 1, wherein said display includes a numeric display including a plurality of digits each composed of seven segments.

10. An electrophotographic copying machine in accordance with claim 9, wherein said numeric display includes a quantity display and a magnification display.

11. An electrophotographic copying machine in accordance with claim 10, wherein each of said quantity display and said magnification display includes a numeric display of relatively small number of digits, said copy management data applied by said second display data applying means being displayed by the total number of digits of said numeric displays of said quantity display and said magnification display.

12. An electrophotographic copying machine, comprising:

a memory card provided with first memory means which has a plurality of storage regions for storing different kinds of copy management data for management of a copy by an electrophotographic copying machine;

a card loading portion for loading said memory card;

mode setting means for setting said electrophotographic copying machine selectively in one of a first mode and a second mode;

a plurality of keys for setting a copying condition;

second memory means having a plurality of storage regions for storing different kinds of copy management data for management of a copy by an electrophotographic copying machine;

a display;

first display data applying means for applying said copying condition which is stored in said second memory means to said display when said first mode is set by said mode setting means;

second display data applying means for applying said copy management data which is stored in said first memory means of said memory card to said display when said second mode is set by said mode setting means;

writing means for writing copy management data in corresponding storage region of a second memory means in response to completion of each copying operation of said electrophotographic copying machine in said first mode; and means for transferring said copy management data which is written by said writing means into corresponding storage region of said first memory means in said memory card in said first mode.

13. An electrophotographic copying machine, comprising:

a memory card provided with memory means to which copy management data for management of a copy by an electrophotographic copying machine is stored;

a card loading portion for loading said memory card;

mode setting means for setting said electrophotographic copying machine selectively in one of a first mode and a second mode;

a plurality of keys for setting a copying condition;

a display;

first display data applying means for applying said copying condition which is set through an operation of said plurality of keys to said display when said first mode is set by said mode setting means; and second display data applying means for applying said copy management data which is stored in said memory means of said memory card to said display when said second mode is set by said mode setting means;

said mode setting means including at least two keys of said plurality of keys, said at least two keys being operated at substantially the same time for setting said second mode, said second display data applying means including display changing means for changing a display content of said copy management data on said display, said display changing means including at least two of said plurality of keys being operated at substantially the same time for changing said display content.

14. An electrophotographic copying machine in accordance with claim 13, wherein said at least two keys include an equal magnification key for providing equal magnification and a paper size selecting key for selecting paper size.

15. An electrophotographic copying machine, comprising:

a memory card provided with memory means to which copy management data for management of a copy by an electrophotographic copying machine is stored;

a card loading portion for loading said memory card;

mode setting means for setting said electrophotographic copying machine selectively in one of a first mode and a second mode;

a plurality of keys for setting a copying condition;

a display including a numeric display with a plurality of digits each composed of seven segments, said numeric display including a quantity display and a magnification display, each of said quantity display and said magnification display including a numeric display having a total number of digits;

first display data applying means for applying said copying condition which is set through an operation of said plurality of keys to said display when said first mode is set by said mode setting means;

second display data applying means for applying said copy management data which is stored in said memory means of said memory card to said display when said second mode is set by said mode setting means, wherein said display displays said copying condition in said first mode and said copy management data in said second mode, respectively, said copy management data applied by said second display data applying means being displayed by the total number of digits of said numeric displays of said quantity display and said magnification display;

a paper size indicator for indicating different paper sizes;

unit price data storing means for storing in advance a unit price for each paper size; and calculating means for calculating a copy cost based upon data of copied quantity from said memory means of said memory card and data of said unit price from said unit price data storing means, said second display data applying means including means for applying a calculation result by said calculating means to said numeric displays.

16. An electrophotographic copying machine in accordance with claim 15, wherein said copy management data includes data of a copied quantity for each paper size, said data of said copied quantity for each paper size and said unit price data being displayed on said numeric displays by displaying a command number on said magnification display and a paper size on said paper size indicator.

17. An electrophotographic copying machine in accordance with claim 1, further comprising writing means for writing copy management data in corresponding storage region of a memory means in response to completion of each copying operation of said electrophotographic copying machine in said first mode.

* * * * *